US005595860A

United States Patent [19]

Ishikawa et al.

[11] Patent Number: 5,595,860

[45] Date of Patent: Jan. 21, 1997

[54] PROCESS FOR THE PROCESSING OF SILVER HALIDE COLOR PHOTOGRAPHIC MATERIAL

[75] Inventors: Takatoshi Ishikawa; Masakazu Yoneyama, both of Kanagawa, Japan

[73] Assignee: Fuji Photo Film Co., Ltd., Kanagawa, Japan

[21] Appl. No.: 429,470

[22] Filed: Apr. 27, 1995

Related U.S. Application Data

[63] Continuation of Ser. No. 5,160, Jan. 15, 1993, abandoned.

[30] Foreign Application Priority Data

Jan. 16, 1992 [JP] Japan ..... 4-024315

[51] Int. Cl.[6] ..... G03C 11/00; G03C 5/18; G03C 5/26; G03C 7/46

[52] U.S. Cl. ..... 430/372; 430/399; 430/488; 430/490; 430/491; 430/493; 430/377; 430/467; 430/469

[58] Field of Search ..... 430/399, 488, 430/490, 491, 493, 372, 377, 467, 469

[56] References Cited

U.S. PATENT DOCUMENTS

| | | | |
|---|---|---|---|
| 4,774,169 | 9/1988 | Kuse et al. | 430/467 |
| 4,876,174 | 10/1989 | Ishikawa et al. | 430/380 |
| 4,900,651 | 2/1990 | Ishikawa et al. | 430/491 |
| 4,912,015 | 3/1990 | Idota | 430/491 |
| 4,966,834 | 10/1990 | Ishikawa et al. | 430/393 |
| 4,985,347 | 1/1991 | Fujimoto et al. | 430/393 |
| 5,004,676 | 4/1991 | Meckl et al. | 430/398 |

FOREIGN PATENT DOCUMENTS

| | | | |
|---|---|---|---|
| 0411513 | 2/1991 | European Pat. Off. | 430/493 |
| 436947A | 7/1991 | European Pat. Off. . | |
| 6242155 | 2/1987 | Japan . | |
| 3240054 | 10/1991 | Japan . | |

OTHER PUBLICATIONS

WO 87/04534, Jul. 30, 1987.

*Research Disclosure*, May 1978, pp. 81–82.

*Primary Examiner*—Anthony McFarlane
*Assistant Examiner*—J. Pasterczyk
*Attorney, Agent, or Firm*—Sughrue, Mion, Zinn, Macpeak & Seas

[57] ABSTRACT

A process for processing a silver halide color photographic material, which comprises developing in a color developer substantially free of sulfite ion and containing an aromatic primary amine color developing agent and at least one phosphorus compound selected from the group consisting of compounds represented by formula (I), formula (I-a) and formula (I-b) and internal salts thereof:

(I)

(I-a)

(I-b)

wherein R, R' and R" each represents an aliphatic hydrocarbon group or an aryl group; A represents a divalent or trivalent linking group; M, M' and M" each represents a hydrogen atom, an alkali metal atom, an alkaline earth metal atom, an ammonium or a quaternary ammonium; and m represents 2 when M, M' or M" is monovalent and m is 1 when M, M' and M" is divalent.

20 Claims, No Drawings

PROCESS FOR THE PROCESSING OF SILVER HALIDE COLOR PHOTOGRAPHIC MATERIAL

This is a continuation of application Ser. No. 08/005,160 filed Jan. 15, 1993, now abandoned.

FIELD OF THE INVENTION

The present invention relates to a process for the processing of a silver halide color photographic material. More particularly, the present invention relates to a process for the processing of a silver halide color photographic material which minimizes the fluctuations of photographic properties (particularly maximum optical density) during continuous processing or accompanying the aging deterioration of a color developer, while eliminating the contamination of the processing tanks and light-sensitive material and inhibiting the separation of a developing agent from the developer at low temperatures.

BACKGROUND OF THE INVENTION

A process for the processing of a silver halide color photographic material which comprises the use of a high silver chloride content emulsion for the purpose of reducing the processing time and inhibiting environmental pollution is described in WO87/04534 and JP-A-61-70552 (U.S. Pat. No. 5,004,676: the term "JP-A" as used herein means an "unexamined published Japanese patent application"). The use of a high silver chloride content emulsion can reduce the processing time, but this approach is disadvantageous in that it causes greater fluctuations of the maximum density with the change in the pH value of the color developer or the change in the concentration of the developing agent.

Sulfites or bisulfites which have heretofore been used as preservatives affect the color density, and the preservative content is therefore preferably minimized. However, if the sulfite or bisulfite content is reduced, a tar which is an oxidation product of a color developing agent is readily formed to thereby undesirably contaminate the light-sensitive material or processing machine. Furthermore, a precipitate derived from the developing agent is readily formed at the interface of the processing solution with air in the processing tank, to thereby cause contamination or flaws. Thus, it has been keenly desired to solve these problems.

Moreover, benzyl alcohol, which has heretofore been used as a color development accelerator, is preferably not used from the standpoint of environmental concerns as discussed in W087/04534. However, if benzyl alcohol is not included in the color developer, another problem arises in that the developing agent precipitates with time at low temperatures during the winter. It has also been keenly desired to solve these problems.

On the other hand, an approach which comprises incorporating various surface active agents in the color developer is described in JP-A-62-234161 (U.S. Pat. No. 4,774,169) and JP-A-62-42155. However, the surface active agents used in these publications cannot sufficiently accomplish the objects of the present invention. The latter publication is silent with respect to the problems solved by the present invention. *Research Disclosure* No. 16986 discloses an approach which comprises incorporating a nonionic surface active agent in the color developer to accelerate the washing of sensitizing dyes, to thereby reduce residual color. However, there is no reference to the problems solved by the present invention. Furthermore, this approach does not provide sufficient effects in the system (a color developer) of the present invention.

JP-A-3-223757 (E.P. 436,947A) and JP-A-3-240054 disclose an approach which comprises incorporating an anionic surface active agent and a nonionic surface active agent in a color developer containing a small amount of sulfite ions, to thereby inhibit the contamination caused by processing. However, this approach exerts a reduced effect and aggravates precipitation of the developing agent at low temperatures. Thus, this approach also leaves much to be desired.

SUMMARY OF THE INVENTION

It is therefore an object of the present invention to reduce the fluctuation of the maximum density during continuous processing, while inhibiting undesirable contamination in the processing tanks (particularly the growth of precipitates at the interface between the processing solution and air).

It is another object of the present invention to inhibit the crystallization of a color developing agent in, e.g., the replenisher tanks at low temperatures.

These and other objects of the present invention will become more apparent from the following detailed description and Examples.

The above objects of the present invention are accomplished by a process for processing an imagewise exposed silver halide color photographic material comprising a support having thereon at least one light-sensitive silver halide emulsion layer, comprising developing in a color developer substantially free of sulfite ion and containing an aromatic primary amine color developing agent and at least one phosphorous compound selected from the group consisting of compounds represented by formula (I) and internal salts derived from the compound:

$$R—A—PO_3M_m \quad (I)$$

wherein R represents an aliphatic hydrocarbon group (i.e., saturated or unsaturated, substituted or unsubstituted, straight-chain or branched alkyl alkenyl and alkynyl group, etc.) or aryl group (substituted or unsubstituted aryl group); A represents a divalent or trivalent linking group; and M represents a hydrogen atom, an alkali metal atom, an alkaline earth metal atom, an ammonium or quaternary ammonium, and m is 2 when M is monovalent and m is 1 when M is divelent. In a preferred embodiment, the objects of the present invention are also accomplished by the above process wherein the imagewise exposed silver halide color photographic material comprises a support having thereon at least one light-sensitive silver halide emulsion layer comprising a high silver chloride content emulsion containing silver halide grains having a mean silver chloride content of at least 90 mol %. Particularly excellent effects of the present invention are obtained by the above process when the color development is carried out at a temperature of 37° C. or higher.

It was quite unexpected that the use of the phosphorus compound of the present invention inhibits not only fluctuation of photographic properties, but also the generation and growth of precipitates in the processing tanks and the crystallization of the developing agent at low temperatures. The term "precipitate" as used herein is not intended to mean a product of deposition or crystallization in a solution due to insufficient solubility, but rather a product of the color developer formed at the vicinity where air and a member of the tank (e.g., a member made of a synthetic resin such as a wall surface and a floating cover) contact. The mechanism for formation of the precipitate and the product formed are different from the mechanism for the deposition or crystallization in the solution and the product formed, respectively. This phenomenon often occurs at a narrow portion such as a corner of the tank and between the tank wall and a floating cover. This phenomenon becomes remarkable when a color developer substantially free of sulfite or bisulfite is employed. Further, this phenomenon becomes remarkable at a development processing temperature of 37° C. or higher. Thus, the effects of the present invention can be remarkably exerted at a processing temperature of 37° C. or higher. Furthermore, fluctuation of photographic properties is remarkably reduced at a processing temperature of 37° C. or higher in accordance with the method of the present invention.

The above described crystallization at low temperatures is a phenomenon in which a color developing agent is crystallized at the bottom of the tank when the running solution or replenisher of a color developer is cooled to a temperature of 10° C. or lower, particularly 5° C. or lower during the winter. The crystallized material clogs the piping system or various pumps, causing maintenance problems. This phenomenon readily occurs, particularly with a color developer free of benzyl alcohol.

DETAILED DESCRIPTION OF THE INVENTION

The present invention is described below in further detail.

In formula (I), the aliphatic hydrocarbon group represented by R preferably contains 1 to 50 carbon atoms and more preferably 6 to 30 carbon atoms. (In the definitions for R, the number of carbon atoms in a group includes the number of carbon atoms in the substituent(s) substituted thereto). The aliphatic hydrocarbon group represented by R may contain at most 5 unsaturated carbon bonds but is preferably free of an unsaturated carbon bond. If R is an aryl group, R represents a $C_{10-24}$ aryl group preferably a substituted or unsubstituted phenyl, naphthyl or anthranyl group such as butylphenyl, octylphenyl, nonylphenyl and dodecylphenyl.

Such an aliphatic hydrocarbon group or aryl group may optionally contain substituents. Preferred examples of such substituents include a halogen atom (e.g., fluorine, chlorine, bromine, iodine), an alkyl group (e.g., methyl, ethyl), an alkoxy group (e.g., methoxy, ethoxy), an acyl group (e.g., acetyl, benzoyl), an acyloxy group (e.g., acetoxy, benzoyloxy), an amino group (e.g., amino, dimethylamino, diethylamino), a hydroxyl group, a nitro group, $—SO_3M^1{}_m$, and $—COOM^1{}_m$, (wherein $M^1$ has the same meaning as M, m is 1 when M1 is monovalent and m' is ½ when $M^1$ is divalent). These substituents may be further substituted with the above described substituents. (In the present invention an acyl group or an acyl moiety include an aliphatic or aromatic acyl group or an aliphatic or aromatic acyl moiety.)

When A represents a trivalent linking group the phosphorus compound represented by formula (I) may be represented by formula (I-a) or formula (I-b):

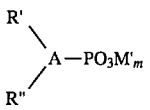

(I-a)

-continued

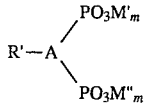

(I-b)

wherein R' and R" each has the same meaning as R in formula (I), M' and M" each has the same meaning as M in formula (I), and m has the same meaning as m in formula (I).

A represents a divalent or trivalent linking group which may be any linking group capable of connecting R to $PO_3M_m$. Preferred examples of such a connecting group are given below.

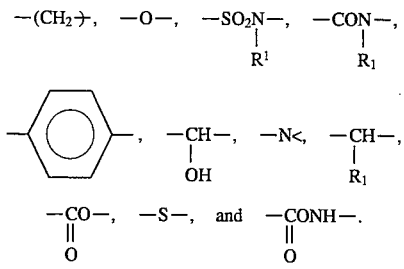

A may be a linking group obtained by combining two or more of these groups. Furthermore, two or more units of the group obtained by combining these groups may be further repeatedly combined. More preferred examples of A are shown below.

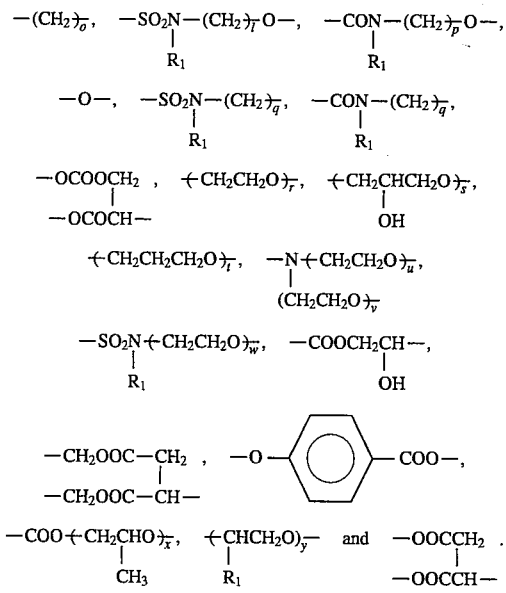

One of the two or three bonding positions in these linking groups is bonded to either R— or $—PO_3M_m$ in formula (I), and a remaining bonding position is bonded to the other of R— and $—PO_3M_m$.

In the above formulae, $R_1$ represents a hydrogen atom or a $C_{1-6}$ alkyl group (an alkyl group having from 1 to 6 carbon atoms) or alkyl group substituted with at least one substituent such as those recited as examples for an aliphatic hydrocarbon group represented by R (a preferred number of carbon atoms of the substituted alkyl group is from 1 to 12), l, o, p, q, r, s, t, u, v, w, x and y each represents an integer of from 1 to 30. When A consists of two or more of the above-described linking groups having the same formula, l, p, q, u, v, w and x in each linking group may be the same or different, and when A is obtained by combining two or more of the linking groups and contains two or more $R_1$ groups, each $R_1$ group may be the same or different. When A is formed by combining two or more of the above-described linking groups, the total number of l to y is preferably 2 to 60, more preferably 2 to 30.

The group represented by A is particularly preferably an alkylene group or alkyleneoxy group.

M represents a hydrogen atom, an alkali metal atom (e.g., Na, K), an alkaline earth metal atom (e.g., Mg, Ca), an ammonium or quaternary ammonium (e.g., pyrimidium, tetramethylammonium).

An internal salt is preferably formed between the substituent at R and $PO_3M_m$ in formula (I).

Phosphoric compounds, particularly phosphoric ester compounds, represented by the formula (I) or its internal salts are preferably used. Specific examples of such compounds for use in the present invention are given below, but the present invention should not be construed as being limited thereto. An alkyl group of the chemical formulae exemplified below represents an n-alkyl group, unless designated as being an iso-alkyl group by the symbol "iso-" or a tert-alkyl group by the symbol "t-".

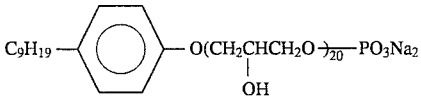
I-1

$C_{16}H_{33}O(CH_2CHO)_3PO_3Na_2$ (CH3) I-2

$C_{12}H_{25}OPO_3Na_2$ I-3

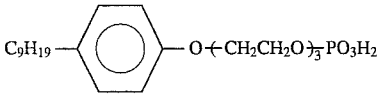
I-4

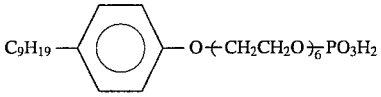
I-5

$C_8H_{17}OPO_3Li_2$ I-6

$C_{12}H_{25}OPO_3K_2$ I-7

$C_8H_{17}(CH_2CH_2O)_{15}PO_3H_2$ I-8

$C_4H_9PO_3^{\ominus\ominus}\{^{\oplus}NH(C_2H_4OH)_3\}_2$ I-9

$C_{12}H_{25}OCH_2CH_2PO_3Na_2$ I-10

$(CH_3)_4{}^{\oplus}NCH_2CH_2OPO_3{}^{\ominus}H$ I-11

$C_5H_{11}SO_2N(CH_2)_3O-PO_3H_2$ (CH3) I-12

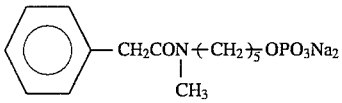
I-13

$C_9H_{19}CON(CH_2)_3OPO_3Na_2$ ($C_2H_5$) I-14

$C_9H_{19}-SO_2N(CH_2)_3PO_3H_2$ (CH3) I-15

-continued

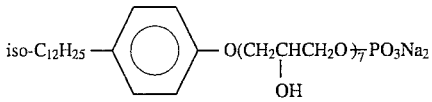
I-16

$C_4H_9OCOOCH_2$ / $CH_3OCOCHPO_3H_2$ I-17

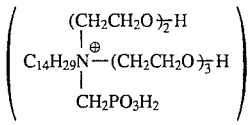
I-18

$C_{16}H_{33}O(CH_2CH_2O)_{10}(CH_2CHCH_2O)_3PO_3H_2$ (OH) I-19

$C_{16}H_{33}N(CH_2CH_2O)_{10}PO_3Na_2$ / $(CH_2CH_2O)_5PO_3Na_2$ I-20

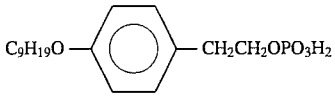
I-21

$C_8H_{17}SO_2-N(CH_2CH_2O)_4(CH_2)_4PO_3Na_2$ ($C_3H_7$) I-22

$C_{10}H_{17}COOCH_2CHCH_2PO_3Na$ (OH) I-23

$CH_3(CH_2)_5CH_2OOC-CH_2$ / $CH_3(CH_2)_5CH_2OOC-CH-PO_3Na_2$ I-24

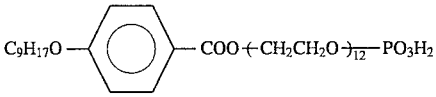
I-25

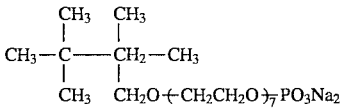
I-26

$C_9H_{17}O(CH_2CH_2O)_9PO_3H_2$ I-27

$C_7H_{15}COO(CH_2CHO)_4(CH_2CH_2O)_{20}PO_3Na_2$ (CH3) I-28

$C_9H_{19}OOCCH_2$ / $C_9H_{19}OOCCHPO_3Na_2$ I-29

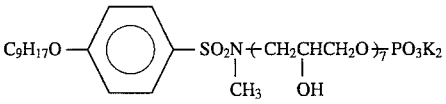
I-30

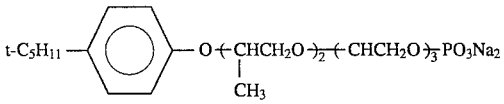
I-31

These surface active agents are disclosed in JP-A-49-10722, JP-A-53-84712, JP-A-54-14224, JP-A-50-113221, JP-A-55-149938, JP-A-54-48520, JP-A-54-14224, JP-A-58-200235, JP-A-57-146248, and JP-A-58-196544, British Patents 1,330,356, 1,417,915, and 1,439,402, U.S. Pat. Nos. 4,335,201, and 4,347,308, and JP-B-52-26687, JP-B-57-26719, and JP-B-59-38573 (the term "JP-B" as used herein means an "examined Japanese patent publication").

The phosphorus compound of the present invention is contained in the color developer and in a replenisher for the color developer generally in an amount of from 0.01 to 10 g, preferably 0.03 to 3 g per l of color developer. Two or more kinds of these compounds may be used in combination as needed. When the amount exceeds 10 g per l, foams tend to generate and in some cases dissolution tends to become insufficient.

In the present invention, the light-sensitive material which has been exposed is subjected to color development, desilvering, and rinsing (or stabilizing).

The color developer for use in the present invention comprises an aromatic primary amine color developing agent. A preferred example of such an aromatic primary amine color developing agent is a p-phenylenediamine derivative. Typical examples of such a p-phenylenediamine derivative include N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline, 2-methyl-4-[N-ethyl-N-(β-hydroxyethyl)amino]aniline, 4-amino-3-methyl-N-ethyl-N-[β-(methanesulfonamido)ethyl]aniline, N-(2-amino-5-diethylaminophenylethyl)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline, and 4-amino-3-methyl-N-ethyl-N-β-butoxyethylaniline. Particularly preferred among these p-phenylenediamine derivatives is 4-amino-3-methyl-N-ethyl-N-[β-(methanesulfonamido)ethyl]aniline.

These p-phenylenediamine derivatives may be in the form of a salt such as a sulfate, a hydrochloride, a sulfite and a p-toluenesulfonate. The color developer contains the aromatic primary amine developing agent in an amount preferably in the range of from about 0.1 g to about 20 g, more preferably about 0.5 g to about 10 g per l.

When the color developing agent concentration of the replenisher to the color developer is preferably about 8 g/l or more, more preferably 9 g/l or more, the phosphorus compound of the present invention is especially useful. A preferred upper limit of the color developing agent in the replenisher is about 30 g/l. In particular, the effects of the present invention are enhanced using 4-amino-3-methyl-N-ethyl-N-[β-(methanesulfonamide)ethyl]aniline as the color developing agent.

In implementing the present invention, when a color developer substantially free of benzyl alcohol is used, remarkable effects are achieved. The term "color developer substantially free of benzyl alcohol" as used herein means a "color developer containing benzyl alcohol preferably in an amount of 2 ml/l or less, more preferably 0.5 ml/l or less, most preferably none".

The color developer for use in the present invention is substantially free of sulfite ion, that is, has a sulfite ion concentration of $3.0\times10^{-3}$ mol/l or less, preferably $1.0\times10^{-3}$ mol/l or less, most preferably none, to suppress fluctuation of photographic properties accompanying continuous processing, and to exert the effects of the present invention. A processing agent kit can contain sulfite to inhibit oxidation of a concentrated developer in such amount so long as the color developer prepared therefrom has a sulfite ion concentration of $3.0\times10^{-3}$ mol/l or less.

As mentioned above, the color developer for use in the present invention is substantially free of sulfite ion. In order to suppress the fluctuation of photographic properties accompanying the variation in concentration of hydroxylamine, the color developer of the present invention is also preferably substantially free of hydroxylamine, that is, has a hydroxylamine concentration of $5.0\times10^{-3}$ mole/l or less, most preferably none.

The color developer for use in the present invention preferably contains an organic preservative instead of the above mentioned hydroxylamine or sulfite ion. A preferred amount of the organic preservative is from about 0.1 to about 30 g/l, and more preferred amount is from about 0.5 to 10 g/l.

The organic preservative for use herein is an organic compound which reduces the deterioration rate of an aromatic primary amine color developing agent by adding to a solution for processing a color photographic light-sensitive material, i.e., an organic compound which inhibits the oxidation of a color developing agent by air or the like. Particularly useful examples of the organic preservative include hydroxylamine derivatives (excluding unsubstituted hydroxylamine), hydroxamic acids, hydrazines, hydrazides, phenols, α-hydroxyketones, α-aminoketones, saccharides, monoamines, diamines, polyamines, quaternary ammonium salts, nitroxy radicals, alcohols, oxims, diamide compounds, and fused ring amines. These organic compounds are disclosed in JP-B-48-30496, JP-A-52-143020, JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, JP-A-1-97953, JP-A-1-186939, JP-A-1-186940, JP-A-1-187557, and JP-A-2-306244, and U.S. Pat. Nos. 3,615,503, and 2,494,930. Other useful preservatives include the various metals disclosed in JP-A-57-44148, and JP-A-57-53749, the salicylic acids disclosed in JP-A-59-180588, the amines disclosed in JP-A-63-239447, JP-A-63-128340, JP-A-1-186939, and JP-A-1-187557, the alkanolamines disclosed in JP-A-54-3532, the polyethyleneimines disclosed in JP-A-56-94349, and the aromatic polyhydroxyl compounds disclosed in U.S. Pat. No. 3,746,544, which may be added to the color developer as needed. In particular, alkanolamines such as triethanolamine, dialkylhydroxylamine such as N,N-diethylhydroxylamine and N,N-di(sulfoethyl)hydroxyamine, hydrazine derivatives (excluding unsubstituted hydrazine) such as N,N-bis(carboxymethyl-)hydrazine or aromatic polyhydroxy compounds such as sodium catechol-3,5-disulfonate are preferably used.

In particular, dialkylhydroxylamine and/or hydrazine derivatives and alkanolamines are preferably used in combination to improve the stability of the color developer and hence the stability during continuous processing.

In the present invention, the color developer preferably (with regard to fog inhibition) contains chloride ions in an amount of $3.0\times10^{-2}$ to $1.5\times10^{-1}$ mol/l, particularly $3.5\times10^{-2}$ to $1\times10^{-1}$ mol/l. A chloride ion concentration exceeding $1.5\times10^{-1}$ mol/l disadvantageously retards development such that the objects of the present invention are not achieved, i.e., rapid processing and high maximum density. On the other hand, a chloride ion concentration below $3.0\times10^{-2}$ mole/l is undesirable with regard to fog inhibition.

In the present invention, the color developer preferably (with regard to fog inhibition) contains bromide ion in an amount of about $3.0\times10^{-5}$ to $1.0\times10^{-3}$ mol/l, more preferably $5.0\times10^{-5}$ to $5.0\times10^{-4}$ mol/l. A bromide ion concentration exceeding $1\times10^{-3}$ mol/l disadvantageously retards the development, thereby lowering the maximum density and sensitivity. On the other hand, a bromide ion concentration below $3.0\times10^{-5}$ mol/l, does not sufficiently inhibit fogging.

Chloride ion and bromide ion may be directly added to the color developer, or may be eluted from the light-sensitive material by the color developer during development processing.

In the former case, useful chloride ion-providing substances include sodium chloride, potassium chloride, ammonium chloride, lithium chloride, magnesium chloride, calcium chloride, etc. Alternatively, chloride ion and bromide ion may be supplied from a fluorescent brightening agent incorporated in the color developer.

Examples of useful bromide ion-providing substances include sodium bromide, potassium bromide, ammonium bromide, lithium bromide, calcium bromide, and magnesium bromide.

In the latter case, chloride ion and bromide ion may be both supplied from the emulsion layer or other constituents of the light-sensitive material.

The color developer for use in the present invention preferably has a pH value of from about 9 to about 12, more preferably about 9 to about 11.0. The color developer may further contain known developer components.

In order to maintain the above specified pH range, various buffers are preferably used. Useful buffers include carbonate, phosphate, borate, tetraborate, hydroxybenzoate, glycyl salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt, lysine salt, etc. In particular, carbonate, phosphate, borate, tetraborate, and hydroxybenzoate are advantageous in that they exhibit excellent solubility and a high buffer action at a pH value as high as 9.0 or higher, do not adversely affect photographic properties (e.g., fog) when incorporated in a color developer, and are inexpensive. Thus, these buffers are particularly preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of the buffer contained in the color developer is preferably in the range of from 0.1 mol/l or more, particularly 0.1 mol/l to 0.4 mol/l.

Furthermore, the color developer may comprise various chelating agents, as calcium or magnesium antiprecipitating agents or to improve the stability of the color developer. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycoletherdiaminetetraacetic acid, ethylenedi-amineorthohydroxyphenylacetic acid, 2-phosphonobutane-1,2,4-tricarboxylic acid, 1-hydroxyethylidene-1,1-diphosphonic acid, N,N'-bis(2-hydroxybenzyl) ethylenediamine-N,N'-diacetic acid, and hydroxyethyliminodiacetic acid. Two or more of these chelating agents may be used in combination.

These chelating agents are generally used in an amount sufficient to block metallic ions in the color developer, e.g., from about 0.1 g to about 10 g per l.

The color developer may comprise a known development accelerator as needed, preferably in an amount of from about 0.01 to 30 g/l.

Examples of useful development accelerators include the thioether compounds disclosed in JP-B-37-16088, JP-B-37-5987, JP-B-38-7826, JP-B-44-12380, and JP-B-45-9019, the p-phenylenediamine compounds disclosed in JP-A-52-49829, and JP-A-50-15554, the quaternary ammonium salts disclosed in JP-A-50-137726, JP-A-56-156826, and JP-A-52-43429, and JP-B-44-30074, the amine compounds disclosed in U.S. Pat. Nos. 2,494,903, 3,128,182, 4,230,796, 3,253,919, 2,482,546, 2,596,926, and 3,582,346, and JP-B-41-11431, the polyalkylene oxide disclosed in JP-B-37-16088, JP-B-42-25201, JP-B-41-11431, and JP-B-42-23883, and U.S. Pat. Nos. 3,128,183, and 3,532,501, 1-phenyl-3-pyrazolidones, and imidazoles. Benzyl alcohol may be used (within the above presented limits) as mentioned above.

In the present invention, a known fog inhibitor may be used as needed. Useful fog inhibitors include a halide of an alkali metal such as sodium chloride, potassium bromide and potassium iodide or an organic fog inhibitor. Typical examples of the organic fog inhibitor include nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethylbenzimidazole, indazole, hydroxyazaindolidine, and adenine.

The color developer for use in the present invention preferably contains a fluorescent brightening agent. The fluorescent brightening agent is preferably a 4,4'-diamino-2,2'-disulfostilbene compound. The addition amount of the fluorescent brightening agent is in the range of from about 0 to 5 g/l, preferably about 0.1 to 4 g/l.

The color developer may further contain various surface active agents such as alkylsulfonic acid, arylsulfonic acid, aliphatic carboxylic acid, aromatic carboxylic acid, and polyalkylene imine as needed, preferably in an amount of from about 0.001 to 10 g/l.

The temperature at which the light-sensitive material is processed in the color developer is between about 20° C. and about 50° C., preferably between about 30° C. and about 40° C. most preferably between about 37° C. and about 40° C. The processing time of the light-sensitive material in the color developer is from about 20 seconds to about 5 minutes, preferably from about 25 seconds to about 1 minute. The replenishment rate of the color developer is in the range of from about 20 to 600 ml, preferably about 30 to 200 ml, more preferably about 40 to 100 ml per $m^2$ of light-sensitive material processed.

The color-developed light-sensitive material is then subjected to desilvering. The desilvering process may be carried out by a conventional method, that is, by effecting the bleaching process and the fixing process separately or simultaneously (blix). In order to expedite processing, a bleaching process may be followed by the blix process. Furthermore, two consecutive blix baths may be used. Alternatively, the fixing process may be effected before the blix process. Moreover, the blix process may be followed by the bleaching process depending on the intended purpose.

Examples of useful bleaching agents for addition to the bleaching bath or blix bath include iron salts, compounds of polyvalent metals such as iron (III), cobalt (III), chromium (IV) and copper (II), peroxides, quinones, and nitro compounds. Typical examples of such bleaching agents include iron chloride, ferricyanide, bichromate, organic complex salt of iron (III) (e.g., complex with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycoletherdiaminetetraacetic acid) , persulfate, bromate, permanganate, and nitrobenzenes. Among these bleaching agents, aminopolycarboxylic acid-iron (III) complexes such as ethylenediaminetetraacetic acid-iron (III) complex and 1,3-diaminopropanetetraacetic acid-iron (III)

complex are preferred for rapid processing and environmental considerations. Furthermore, these aminopolycarboxylic acid-iron (III) complexes are particularly useful in the bleaching bath and blix bath. The bleaching bath or blix bath comprising such an aminopolycarboxylic acid-iron (III) complex is used at a pH value of from about 3 to about 8.

The bleaching bath or blix bath may comprise known additives such as a rehalogenating agent (e.g., ammonium bromide, ammonium chloride), a pH buffer (e.g., ammonium nitrate) and a metal corrosion inhibitor (e.g., ammonium sulfate).

Besides these compounds, the bleaching bath or blix bath preferably comprises an organic acid for inhibiting bleach stain. A particularly preferred organic acid is a compound having an acid dissociation constant (pKa) of from about 2 to about 5.5. Specifically, acetic acid and propionic acid are preferably used.

Examples of useful fixing agents for addition to the fixing bath or blix bath include thiosulfates, thiocyanates, thioether compounds, thioureas, iodides (when used in a large amount), etc. Thiosulfates are generally used. In particular, ammonium thiosulfate is most widely used. Furthermore, thiosulfates are preferably used in combination with thiocyanates, thioether compounds, thioureas, etc.

Examples of useful preservatives for addition to the fixing bath or blix bath preferably include sulfites, bisulfites, carbonyl-bisulfurous acid adducts or the sulfinic acid compounds described in European Patent 294769A. The fixing bath or blix bath preferably comprises various aminopolycarboxylic acids or organic phosphonic acids (e.g., 1-hydroxyethylidene-1,1-diphosphonic acid, N,N,N',N'-ethylenediaminetetraphosphonic acid) for stabilizing the solution.

The fixing bath or blix bath may further comprise , various fluorescent brightening agents, anti-foaming agents and surface active agents, polyvinyl pyrrolidone, methanol, etc.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patent 1,290,812, JP-A-53-95630, and *Research Disclosure* No. 17129 (July 1978), thiazolidine derivatives as described in JP-A-50-140129, thiourea derivatives as described in U.S. Pat. No. 3,706,561, iodides as described in JP-A-58-16235, polyoxyethylene compounds as described in West German Patent 2,748,430, polyamine compounds as described in JP-B-45-8836, and bromide ion. Preferred among these compounds are compounds containing a mercapto group or disulfide group because of their considerable accelerating effect. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. These bleaching accelerators may also be incorporated into the light-sensitive material. These bleaching accelerators are particularly effective for blix of color light-sensitive materials for picture taking.

The total time required for the desilvering step is preferably as short as possible so long as the desilvering is complete. The desilvering time is preferably in the range of from about 10 seconds to about 3 minutes, more preferably from about 20 seconds to about 2 minutes. The processing temperature is in the range of from about 25° C. to about 50° C., preferably about 35° C. to about 45° C. In the preferred temperature range, the desilvering rate is improved and stain after processing is effectively inhibited.

In the desilvering step, the agitation is preferably intensified to the extent possible. Specific examples of such an agitation intensifying method include the method as described in JP-A-62-183460 and JP-A-62-183461 which comprises jetting the processing solution to the surface of the emulsion layer of the light-sensitive material, the method as described in JP-A-62-183461 which comprises improving the agitating effect by a rotary means, a method which comprises improving the agitating effect by moving the light-sensitive material while the emulsion surface is in contact with a wiper blade provided in the bath so that turbulance occurs at the emulsion surface, and a method which comprises increasing the total circulated amount of processing solution. Such an agitating improving method is effectively applied to the bleaching bath, blix bath or fixing bath. The improvement in agitation effect is considered to expedite the supply of a bleaching agent, fixing agent or the like to the emulsion film, resulting in an improved desilvering rate. The above described agitation improving means is more effective when a bleach accelerator is used, thereby remarkably increasing the bleach acceleration effect and eliminating the fixing inhibition effect of the bleach accelerator.

The automatic developing machine for use in processing the light-sensitive material of the present invention is preferably equipped with a light-sensitive material conveying means as disclosed in JP-A-60-191257, JP-A-60-191258, and JP-A-60-191259. As described in JP-A-60-191257, such a conveying means remarkably reduces the amount of the processing solution carried from a bath to the subsequent bath, to thereby suppress deterioration of the properties of the processing solution. This reduction in carryover amount is remarkably effective for reducing the processing time or for reducing the amount of replenisher required at each processing step.

The thus desilvered color photographic light-sensitive material of the present invention is then generally subjected to water washing. Stabilization may be effected instead of washing, or in addition to washing. In the stabilization step, any of known methods as disclosed in JP-A-57-8543, JP-A-58-14834, and JP-A-60-220345 may be used. A washing-stabilization step may be effected, where a stabilizing bath containing a dye stabilizer and a surface active agent is used as a final bath for processing a color photographic light-sensitive material for picture taking.

The washing bath and stabilizing bath may contain a water softener such as inorganic phosphoric acid, a polyaminocarboxylic acid and an organic aminophosphonic acid, a metal salt such as a magnesium salt, an aluminum salt and a bismuth salt, a surface active agent, a film hardener, etc.

The quantity of water for use in the washing varies depending on the characteristics of the light-sensitive material (for example, depending on materials used therein, such as couplers contained therein, etc.), the end use of the light-sensitive material, the temperature of the washing water, the number of washing tanks (number of stages), the replenishment system (e.g., counter-flow system or direct-flow system), and other various factors. In order to contend with problems such as proliferation of bacteria or attachment of floating masses of bacteria to the light-sensitive material due to use of a low replenishment rate of washing water in a multistage counter-flow system, the method as disclosed in JP-A-62-288838 which comprises reducing calcium and magnesium ion concentrations is very effective. Furthermore, it is also effective to use isothiazolone compounds or thiabenzazoles as described in JP-A-57-8542, chlorine-containing bactericides, e.g., chlorinated sodium isocyanurate, benzotriazole, and the bactericides described in Hiroshi Horiguchi, "Bokinbobaizai no kagaku" (published by Sankyo Shuppan; 1986), Eisei Gijutsu Gakkai (ed.), "Biseibutsu no mekkin, sakkin, bobaigijutsu" (Kogyo Gijutsu-kai; 1982), and Nippon Bokin Bobai Gakkai (ed.), "Bokin bobaizai jiten" (1986).

The washing water has a pH value of from about 4 to about 9, preferably from about 5 to about 8. The temperature of the water and the washing time vary depending on the characteristics and end use of the light-sensitive material, but usually ranges from about 15° to 45° C. in temperature and from about 20 seconds to about 10 minutes in time, preferably from about 25 to 40° C. in temperature and from about 30 seconds to about 5 minutes in time.

Examples of dye stabilizers which can be incorporated in the stabilizing solution include aldehydes such as formaldehyde and glutaraldehyde, N-methylol compounds, hexamethylenetetramine, and aldehyde-sulfurous acid adducts. The stabilizing solution may further contain a pH adjusting buffer such as boric acid and sodium hydroxide, a chelating agent such as 1-hydroxyethylidene-1,1-diphosphonic acid and ethylenediaminetetraacetic acid, a sulfurization inhibitor such as alkanolamine, a fluorescent brightening agent, a mildew-proofing agent, etc.

The overflow accompanying replenishment of the washing bath and/or stabilizing bath can be reused in other processing step such as desilvering.

In processing using an automatic developing machine, water is preferably added to the various processing baths of the system to correct for concentration due to evaporation.

The color photographic light-sensitive material of the present invention may contain a color developing agent to simplify and expedite processing. Such a color developing agent is preferably used in the form of a precursor. Examples of such precursors include indoaniline compounds as described in U.S. Pat. No. 3,342,597, Schiff's base type compounds as described in U.S. Pat. No. 3,342,599, and *Research Disclosure* Nos. 14,850 and 15,159, and aldol compounds as described in *Research Disclosure* No. 13,924, metal complexes as described in U.S. Pat. No. 3,719,492, and urethane compounds as described in JP-A-53-135628.

The color photographic light-sensitive material of the present invention may optionally contain various 1-phenyl-3-pyrazolidones to accelerate color development. Typical examples of such compounds are described in JP-A-56-64339, JP-A-57-144547, and JP-A-58-115438.

The method of the present invention may be applied to any light-sensitive materials. The silver halide emulsions and other materials (additives) for incorporation into the light-sensitive material of the present invention, the photographic constituent layers (layer arrangement) of the light-sensitive material of the present invention, and the processing methods and processing additives for processing the light-sensitive materials are preferably those described in the following patents, particularly European Patent 0,355,660A2 (corresponding to JP-A-2-139544):

| Photographic constituent | JP-A-62-215272 | JP-A-2-33144 | EP0,355,660A2 |
|---|---|---|---|
| Silver halide emulsion | Line 6, upper right column, p. 10–line 5, lower left column, p. 12 & last line 4, lower right column, p. 12–line 17, upper left column, p. 13 | Line 16, upper right column, p. 28–line 11, lower right column, p. 29 & line 2–line 5, p. 30 | Line 53, p. 45–line 3, p 47 & line 20–line 22, p. 47 |
| Silver halide solvent | Line 6–line 14, lower left column, p. 12 & last line 3, upper left column, p. 13–last line, lower left column, p. 18 | — | — |
| Chemical sensitizer | Last line 3, lower left column–last line 5, lower right column, p. 12 & line 1, lower right column, p. 18–last line 9, upper right column, p. 22 | Line 12–last line, lower right column, p. 29 | Line 4–line 9, p. 47 |
| Spectral sensitizer (spectral sensitizing method) | Last line 8, upper right column, p. 22–last line on p. 38 | Line 1–line 13, upper left column, p. 30 | Line 10–line 15, p. 47 |
| Emulsion stabilizer | Line 1, upper left column, p. 39–last line, upper right column, p. 72 | Line 14, upper left column–line 1, upper right, p. 30 | Line 16–line 19, p. 47 |
| Development accelerator | Line 1, lower left column, p. 72–line 3, upper right column, p. 91 | — | — |
| Color coupler cyan, magenta, yellow couplers) | Line 4, upper right column, p. 91–line 6, lower left column, p. 121 | Line 14, upper right column, p. 3–last line, upper left column, p. 35 & line 6, upper right column, p. 30–line 11, lower right column, p. 35 | Line 15–line 27, p. 4, line 30, p. 5–last line on p. 28, line 29–line 31, p. 45 & line 23, p. 47–line 50, p. 63 |
| Color intensifier | Line 7, upper left column, p. 121–line 1, upper right column, p. 125 | — | — |
| Ultraviolet | Line 2, upper right column, | Line 14, lower right column, | Line 22–line 31, |

-continued

| Photographic constituent | JP-A-62-215272 | JP-A-2-33144 | EP0,355,660A2 |
|---|---|---|---|
| absorbent | p. 125–last line, lower left column, p. 127 | p. 37–line 11, upper left column, p. 38 | p. 65 |
| Discoloration inhibitor (image stabilizer) | Line 1, lower right column, p. 127–line 8, lower left column, p. 137 | Line 12, upper right column, p. 36–line 19, upper left column, p. 37 | Line 30, p. 4–line 23, p. 5, line 1, p. 29–line 25, p. 45, line 33–40, p. 45 & line 2–21, p. 65 |
| High boiling and/or low boiling organic solvent | Line 9, lower left column, p. 137–last line, upper right column, p. 144 | Line 14, lower right column, p. 35–last line 4, upper left column, p. 36 | Line 1–51, p. 64 |
| Process for dispersion of photographic additives | Line 1, lower left column, p. 144–line 7, upper right column, p. 146 | Line 10, lower right column, p. 27–last line, upper left column, p. 28 & line 12, lower right column, p. 35–line 7, upper right column, p. 36 | Line 51, p. 63–line 56, p. 64 |
| Film hardener | Line 8, upper right column, p. 146–line 4, lower left column, p. 155 | — | — |
| Developing agent precursor | Line 5, lower left column, p. 155–line 2, lower right column, p. 155 | — | — |
| Development inhibitor-releasing compound | Line 3–9, lower right column, p. 155 | — | — |
| Support | Line 19, lower right column, p. 155–line 14, upper left column, p. 156 | Line 18, upper right column, p. 38–line 3, upper left column, p. 39 | Line 29, p. 66–line 13, p. 67 |
| Constitution of light-sensitive layers | Line 15, upper left column, p. 156–line 14, lower right column, p. 156 | Line 1–15, upper right column, p. 28 | Line 41–52, p. 45 |
| Dye | Line 15, lower right column, p. 156–last line, lower right column, p. 184 | Line 12, upper left column,–line 7, upper right column, p. 38 | Line 18–line 22, p. 66 |
| Color mixing inhibitor | Line 1, upper left column, p. 185–line 3, lower right column, p. 188 | Line 8–11 upper right column, p. 36 | Line 57, p. 64–line 1, p. 65 |
| Gradation adjustor | Line 4–8, lower right column, p. 188 | — | — |
| Stain inhibitor | Line 9, lower right column, p. 188–line 10, lower right column, p. 193 | Last line, upper left column–line 13, lower right column, p. 37 | Line 32, p. 65–line 17, p. 66 |
| Surface active agent | Line 1, lower left column, p. 201–last line, upper right column, p. 210 | Line 1, upper right column, p. 18–last line, lower right column, p. 24 & last line 10, lower left column–line 9, lower right column, p. 27 | — |
| Fluorine-containing compound (as antistatic agent, coating aid, lubricant, adhesion inhibitor, etc) | Line 1, lower left column, p. 210–line 5, lower left column, p. 222 | Line 1, upper left column, p. 25–line 9, lower right column, p. 27 | — |
| Binder (hydrophilic colloid) | Line 6, lower left column, p. 222–last line, upper left column, p. 225 | Line 8–18, upper left column, p. 38 | Line 23–28, p. 66 |
| Thickening agent | Line 1, upper right column, p. 225–line 2, upper right column, p. 227 | — | — |
| Antistatic agent | Line 3, upper right column, p. 227–line 1, upper left column, p. 230 | — | — |
| Polymer latex | Line 2, upper left column, p. 230–last line, p. 239 | — | — |
| Matting agent | Line 1, upper left column, p. 240–last line, upper right column, p. 240 | — | — |
| Photographic processing method | Line 7, upper right column, p. 3–line 5, upper right column, p. 10 | Line 4, upper left column, p. 39–last line, upper left column, p. 42 | Line 14, p. 67–line 28, p. 69 |

-continued

| Photographic constituent | JP-A-62-215272 | JP-A-2-33144 | EP0,355,660A2 |
|---|---|---|---|
| (processing step, additives, etc.) | | | |

Note)
The contents cited in JP-A-62-215272 include the contents described in the written amendment of procedure dated March 16, 1987 attached thereto.
Among the above mentioned color couplers, useful yellow couplers include the short wave type yellow couplers as disclosed in JP-A-63-231451, JP-A-63-123047, JP-A-63-241547, JP-A-1-173499, JP-A-1-213648, and JP-A-1-250944.

Useful cyan couplers preferably include the 3-hydroxypyridine cyan couplers as disclosed in European Patent (EP) 0,333,185A2 (particularly those which have been rendered two-equivalent by incorporating therein a chlorine-separatable group as exemplified by Coupler (42), Coupler (6) and Coupler (9)) or the cyclic active methylene cyan couplers as disclosed in JP-A-64-32260 (particularly exemplified Coupler 3, 8, 34) besides the diphenylimidazole cyan couplers as disclosed in JP-A-2-33144.

The silver halide for use in the light-sensitive emulsion layers of the light-sensitive material of the present invention includes silver chloride, silver bromide, silver chlorobromide, silver bromochloroiodide, silver bromoiodide or the like. In particular, in order to accomplish the objects of the present invention, a silver bromochloride or silver chloride emulsion having a silver chloride content of 90 mol % or more, more preferably 95 mol % or more, particularly 98 mol % or more and substantially free of silver iodide is preferably used.

The light-sensitive material of the present invention preferably comprises a dye (particularly an oxonol dye) decolorable by processing as disclosed in European Patent No. 0,337,490A2, pp. 27–76, in a hydrophilic colloidal layer in such amount that the optical reflective density of the light-sensitive material at 80 nm is 0.70 or more, or titanium oxide surface treated with an alcohol having a valence of 2 to 4 (e.g., trimethylolethane) in the water-resistant resin layer of the support in an amount of 12% by weight or more (more preferably 14% by weight or more) for the purpose of improving image sharpness of image or the like.

The light-sensitive material of the present invention preferably comprises a dye image preservability improving compound as disclosed in European Patent 0,277,589A2 in combination with a coupler, particularly a pyrazoloazole coupler.

In particular, the compound (F) as disclosed in European Patent 0,277,589A2 which chemically bonds to an aromatic amine developing agent remaining after color development to produce a chemically inert and substantially colorless compound and/or the compound (G) which chemically bonds to the oxidation product of an aromatic amine color developing agent remaining after color development to produce a chemically inert and substantially colorless compound are preferably used singly or in combination. These dye image preservability improving compounds inhibit the occurrence of stain or other side effects caused by the formation of developed dyes by the reaction of a color developing agent or its oxidation product remaining in the film with a coupler upon storage after processing.

The light-sensitive material of the present invention preferably comprises a mildew-proofing agent as disclosed in JP-A-63-271247 to prevent propagation of various mildew and bacteria in the hydrophilic colloidal layer and resulting deterioration of the image.

The support for use in the light-sensitive material of the present invention includes a white polyester support for display or a support comprising a white pigment-containing layer on the silver halide emulsion layer side. In order to further improve image sharpness, an antihalation layer is preferably coated on the silver halide emulsion side or opposite side of the support. In order to enable display through reflected light or transmitted light, the transmission density of the support is preferably adjusted to a range of from 0.35 to 0.8.

The light-sensitive material of the present invention may be imagewise exposed to visible light or infrared light. Exposure may be carried out by a low intensity exposure process or a high intensity short-time exposure process. In the latter case, a laser scanning exposure process with an exposure time of not more than $10^{-4}$ seconds per pixel is preferably used.

In exposure, a band stop filter as described in U.S. Pat. No. 4,880,726 is preferably used. This removes light color mixing, to thereby remarkably improve color reproducibility.

The present invention is further described by reference to the following examples, but the present invention should not be construed as being limited thereto.

EXAMPLE 1

The surface of a polyethylene double-laminated paper support was subjected to corona discharge. On the paper support was provided a gelatin undercoating layer containing sodium dodecylbenzenesulfonate. On the undercoating layer were coated various photographic constituent layers to prepare a multilayer color photographic paper A having the following layer construction. The coating solutions were prepared as follows:

Preparation of 5th Layer Coating Solution

To 32.0 g of a cyan coupler (ExC), 3.0 g of a dye image stabilizer (Cpd-2), 2.0 g of a dye image stabilizer (Cpd-4), 18.0 g of a dye image stabilizer (Cpd-6), 40.0 g of a dye image stabilizer (Cpd-7) and 5.0 g of a dye image stabilizer (Cpd-8) were added 50.0 ml of ethyl acetate and 14.0 g of a solvent (Solv-6) to make a solution. The solution thus obtained was then added to 500 ml of a 20 wt. 5 % aqueous solution of gelatin containing 8 ml of sodium dodecylbenzenesulfonate. The mixture was then subjected to emulsion dispersion by means of an ultrasonic homogenizer to prepare an emulsion dispersion. On the other hand, a silver bromochloride emulsion (1:4 (Ag molar ratio) mixture of a large size emulsion of cubic grains having an average size of 0.58 μm with a grain size distribution fluctuation coefficient of 0.09 and a small size emulsion of cubic grains having an average size of 0.45 μm with a grain size distribution fluctuation coefficient of 0.11, 0.6 mol % silver bromide partially localized on the grain surface of each emulsion) was prepared. This emulsion comprised a red-sensitive sensitizing dye E having the chemical structure set forth below in an amount of $0.9\times10^{-4}$ mol per mol of Ag for the large size emulsion and $1.1\times10^{-4}$ mol per mol of Ag for the small size emulsion. The chemical ripening of this emulsion was carried out by the addition of a sulfur sensitizer and a gold sensitizer. The previously prepared emulsion dispersion and the red-sensitive silver bromochloride emulsion were mixed to prepare a coating solution for the 5th layer having the formulations set forth below.

The coating solutions for the 1st layer to the th layer, the 6th layer and the 7th layer were prepared in the same manner as the coating solution for the 5th layer. The sodium salt of 1-oxy-3,5-dichloro-s-triazine was added to each layer as a gelatin hardener. To each of these layers were added Cpd-10 and Cpd-11 in a total amount of 25.0 mg/m$^2$ and 50.0 mg/m$^2$, respectively.

To the silver bromochloride emulsion in these light-sensitive emulsion layers were added the following spectral sensitizing dyes.

Blue-Sensitive Emulsion Layer

Sensitizing dye A

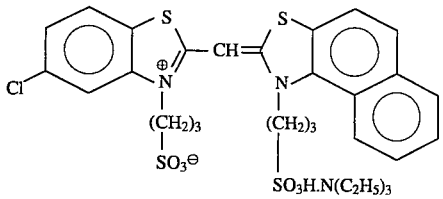

Sensitizing dye B

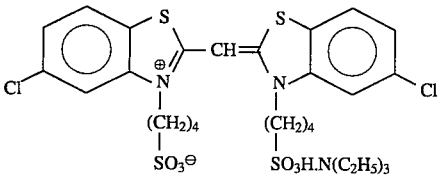

($2.0\times10^{-4}$ mole per mole of silver halide for the large size emulsion and $2.5\times10^{-4}$ mole per mole of silver halide for the small size emulsion)

Green-Sensitive Emulsion Layer

Sensitizing dye C

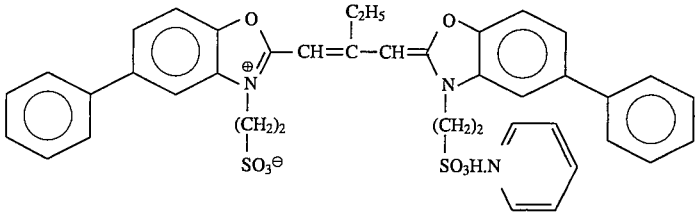

($4.0\times10^{-4}$ mol per mol of silver halide for the large size emulsion and $5.6\times10^{-4}$ mol per mol of silver halide for the small size emulsion Sensitizing dye D

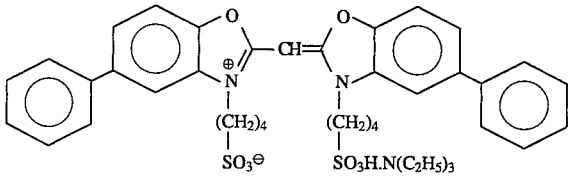

($7.0\times10^{-5}$ mol per mol of silver for the large size emulsion and $1.0\times10^{-5}$ mol per mol of silver halide for the small size emulsion).

Red-Sensitive Emulsion Layer

Sensitizing dye E

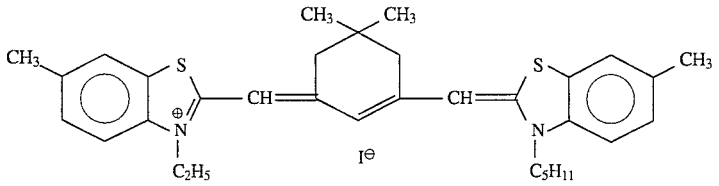

($0.9\times10^{-4}$ mol per mol of silver halide for the large size emulsion and $1.1\times10^{-4}$ mol per mol of silver halide for the small size emulsion)

Furthermore, a compound having the chemical structure set forth below was added to the emulsion in an amount of $2.6\times10^{-3}$ mol per mol of silver halide.

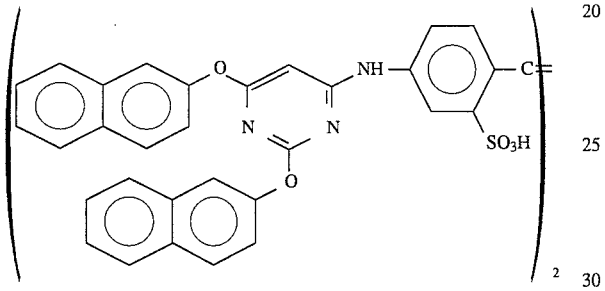

To each of the blue-sensitive emulsion layer, the green-sensitive emulsion layer and the red-sensitive emulsion layer were added 1-(5-methylureidophenyl)-5-mercapto-tetrazole in an amount of $8.5\times10^{-5}$ mol, $7.7\times10^{-4}$ mol and $2.5\times10^{-4}$ mol per mol of silver halide, respectively. To each of the blue-sensitive emulsion layer and the green-sensitive emulsion layer were added 4-hydroxy-6-methyl-1,3,3a,7-tetrazaindene in an amount of $1\times10^{-4}$ mol and $2\times10^{-4}$ mol per mol of silver halide, respectively.

To inhibit irradiation, the following dyes were added to each of the emulsion layers (figures in the parenthesis indicate the coated amount in each layer):

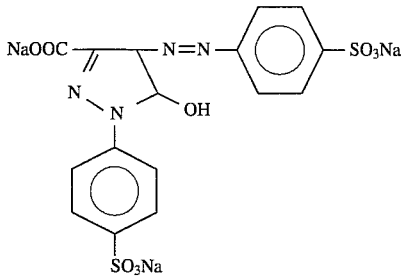

(10 mg/m²)

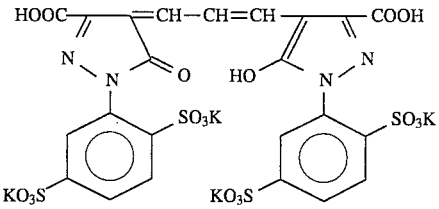

(10 mg/m²)

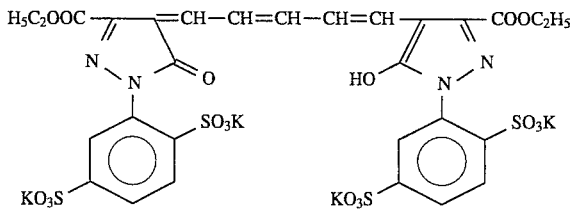

(40 mg/m²)

-continued

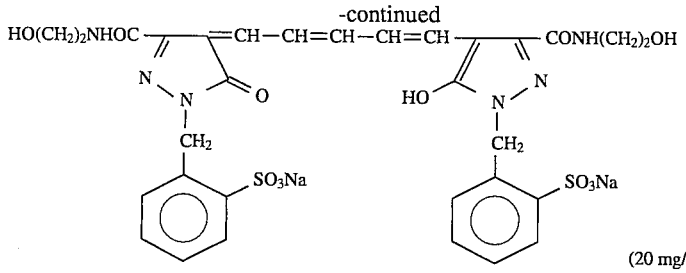

(20 mg/m²)

Layer Construction

The formulations of the various layers are set forth below. The figures indicate the coated amount (g/m²). The coated amount of silver halide emulsion is expressed (by calculation) in terms of the coated amount of silver.

| | |
|---|---|
| Support | |
| Polyethylene-laminated paper [containing a white pigment ($TiO_2$) and a bluish dye (ultramarine) in polyethylene on the 1st layer side] | |
| 1st layer (blue-sensitive emulsion layer) | |
| Silver bromochloride emulsion (3:7 (Ag molar ratio) mixture of a large size emulsion of cubic grains having an average size of 0.88 μm with a grain size distribution fluctuation coefficient of 0.08 and a small size emulsion of cubic grains having an average size of 0.70 μm with a grain size distribution fluctuation coefficient of 0.10, 0.3 mol % silver bromide partially localized on the grain surface of each emulsion) | 0.30 |
| Gelatin | 1.86 |
| Yellow coupler (ExY) | 0.82 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| 2nd layer (color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| 3rd layer (green-sensitive emulsion layer) | |
| Silver bromochloride emulsion (1:3 (Ag molar ratio) mixture of a large size emulsion of cubic grains having an average size of 0.55 μm with a grain size distribution fluctuation coefficient of 0.10 and a small size emulsion of cubic grains having an average size of 0.39 μm with a grain size distribution fluctuation coefficient of 0.08, 0.8 mol % silver bromide partially localized on the grain surface of each emulsion) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| 4th layer (ultraviolet absorbing layer) | |
| Gelatin | 1.58 |
| Ultraviolet absorbent (UV-1) | 0.47 |
| Color mixing inhibitor (Cpd-5) | 0.05 |
| Solvent (Solv-5) | 0.24 |

-continued

| | |
|---|---|
| 5th layer (red-sensitive emulsion layer) | |
| Silver bromochloride emulsion (1:4 (Ag molar ratio) mixture of a large size emulsion of cubic grains having an average size of 0.58 μm with a grain size distribution fluctuation coefficient of 0.09 and a small size emulsion of cubic grains having an average size of 0.45 μm with a grain size distribution fluctuation coefficient of 0.11, 0.6 mol % silver bromide partially localized on the grain surface of each emulsion) | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| 6th layer (ultraviolet absorbing layer) | |
| Gelatin | 0.53 |
| Ultraviolet absorbent (UV-1) | 0.16 |
| Color mixing inhibitor (Cpd-5) | 0.02 |
| Solvent (Solv-5) | 0.08 |
| 7th layer (protective layer) | |
| Gelatin | 1.33 |
| Acryl-modified copolymer of polyvinyl alcohol (modification degree: 17%) | 0.17 |
| Liquid paraffin | 0.33 |

The chemical structures of the compounds incorporated into these layers are set forth below.

Yellow coupler (ExY)
1:1 (molar ratio) mixture of
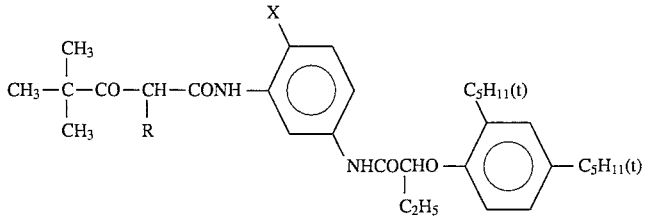
wherein R is
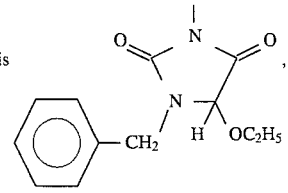
, X = Cl and R is
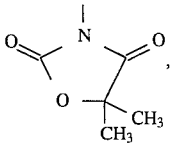
, X = $OCH_3$
Magenta coupler (ExM)
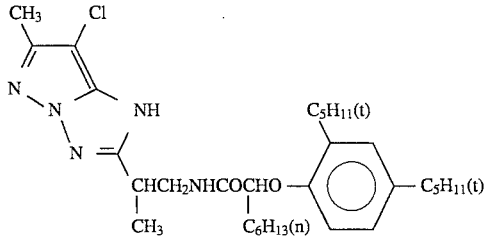
Cyan coupler (ExC)
1:1 (molar ratio) of:
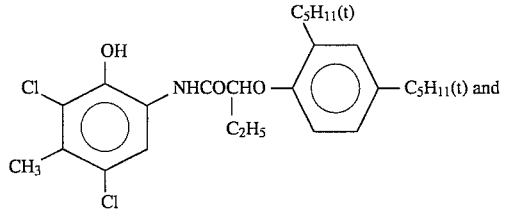
and
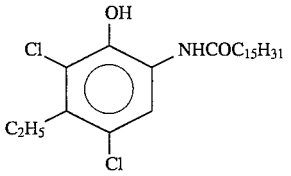
Dye stabilizer (Cpd-1)
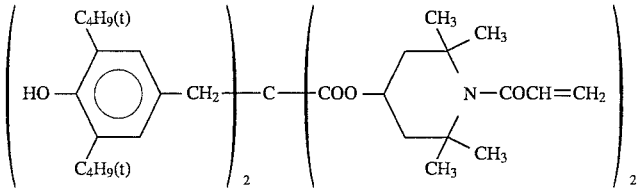
Dye stabilizer (Cpd-2)
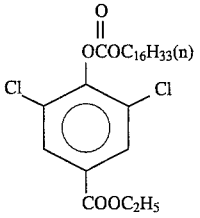

-continued
Dye stabilizer (Cpd-3)
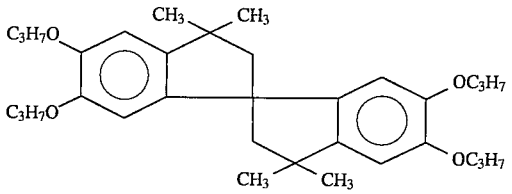
Dye stabilizer (Cpd-4)
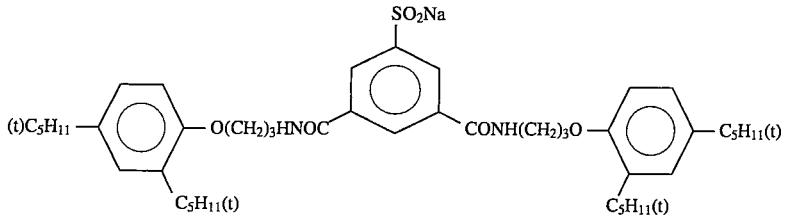
Color stabilizer (Cpd-5)
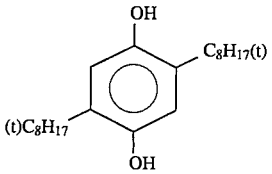
Dye stabilizer (Cpd-6)
2:4:4 (weight ratio) of:
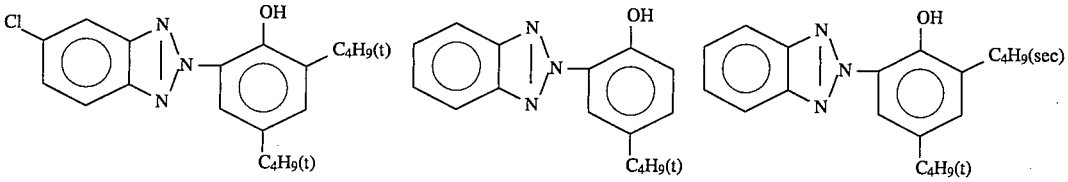
Dye stabilizer (Cpd-7)
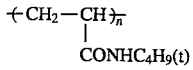
(Average molecular weight - 60,000)
Dye image stabilizer (Cpd-8)
1:1 (weight ratio) of:
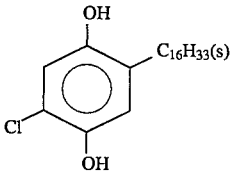
and
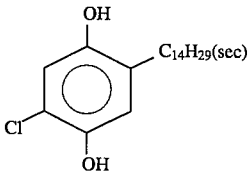
Dye stabilizer (Cpd-9)
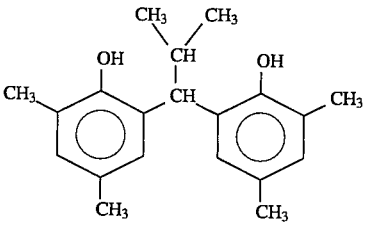

-continued
Preservative (Cpd-10)
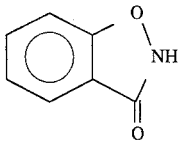
Preservative (Cpd-11)
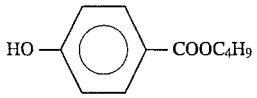
Ultraviolet absorbent (UV-1)
4:2:4 (weight ratio) mixture of:
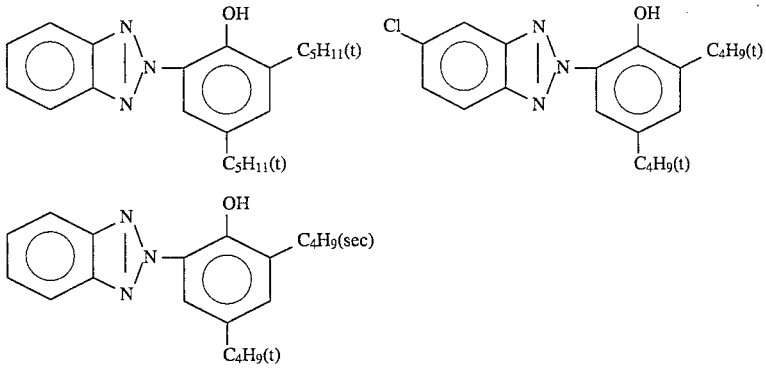
Solvent (Solv-1)
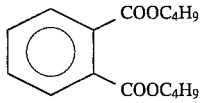
Solvent (Solv-2)
1:1 (volumetric ratio) mixture of:
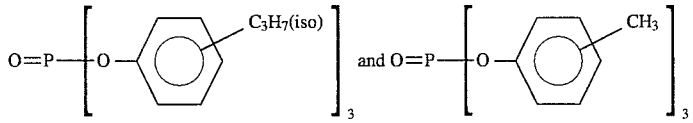
Solvent (Solv-3)
$O{=}P{+}O{-}C_9H_{19}(iso)]_3$
Solvent (Solv-4)
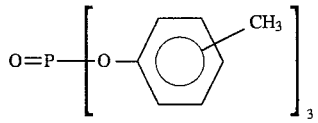
Solvent (Solv-5)
$COOC_8H_{17}$
|
$(CH_2)_8$
|
$COOC_8H_{17}$ Solvent (Solv-6)
80:20 (volumetric ratio) mixture of:

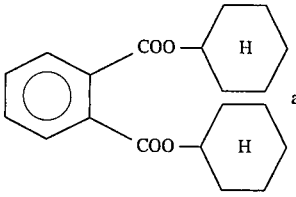

and $C_8H_{17}CH\underset{O}{\underset{\backslash}{C}}H(CH_2)_7COOC_8H_{17}$

Solvent (Solv-7)

$C_8H_{17}CH\underset{O}{\underset{\backslash}{C}}H(CH_2)_7COOC_8H_{17}$

In a running test, the light-sensitive material prepared as described above was imagewise exposed to light by means of an automatic printer FAP3500 (produced by Fuji Photo Film Co., Ltd.), and then subjected to continuous processing (running test) with the following processing solutions and the following processing steps until the color developer was replenished by an amount twice the developer volume. The running test was effected with various formulations of the color developer as set forth in Table 6.

| Processing step | Temperature | Time | Replenisher* | Tank capacity |
|---|---|---|---|---|
| Color development | 38.5° C. | 45 sec. | 60 ml/m² | 17 l |
| Blix | 30–35° C. | 45 sec. | 60 ml/m² | 17 l |
| Rinse 1 | 30–35° C. | 20 sec. | — | 8 l |
| Rinse 2 | 30–35° C. | 20 sec. | — | 8 l |
| Rinse 3 | 30–35° C. | 20 sec. | — | 8 l |
| Rinse 4 | 30–35° C. | 30 sec. | 200 ml/m² | 8 l |

The rinse step was effected in a counter-flow process wherein the washing water flew from steps of Rinse 4 to Rinse 1 through steps of Rinse 3 and Rinse 2.

The formulations of the various processing solutions were as follows:

| Color developer | Tank Solution | Replenisher |
|---|---|---|
| Water | 800 ml | 800 ml |
| EDTA.2Na | 3 g | 3 g |
| Sodium catechol-3,5-di-sulfonate | 0.3 g | 0.3 g |
| Triethanolamine | 8.0 g | 8.0 g |
| Potassium bromide | 0.03 g | — |
| Sodium chloride | 6.0 g | — |
| N,N-di(sulfoethyl)hydroxyl-amine | 5.0 g | 8.0 g |
| Fluorescent brightening agent (Whitex 4 produced by Sumitomo Chemical Co., Ltd.) | 1.0 g | 2.0 g |
| Sodium sulfite | See Table 6 | |
| Additive (see Table 6) | 0.2 g | 0.2 g |
| N-ethyl-N-(β-methanesulfon-amidoethyl-3-methyl-4-amino-aniline sulfate | 5.0 g | 12.0 g |
| Water to make | 1,000 ml | 1,000 ml |
| pH (25° C.) | 10.05 | 11.15 |

| Blix solution in tank | |
|---|---|
| Water | 800 ml |
| Ammonium thiosulfate (50 wt %) | 120 ml |

-continued

| | |
|---|---|
| Ammonium sulfite | 17 g |
| Ammonium ethylenediaminetetraacetate iron(III) | 60 g |
| Disodium ethylenediaminetetraacetate | 3 g |
| Glacial acetic acid | 7 g |
| Water to make | 1,000 ml |
| pH (25° C.) | 5.50 |

| Blix solution replenisher | |
|---|---|
| Water | 500 ml |
| Ammonium thiosulfate (50 wt %) | 220 ml |
| Ammonium sulfite | 35 g |
| Ammonium ethylenediaminetetraacetate iron(III) | 110 g |
| Ethylenediaminetetraacetic acid | 3 g |
| Glacial acetic acid | 25 g |
| Water to make | 1,000 ml |
| pH (25° C.) | 4.80 |

Washing Solution (The Tank Solution was also used as the Replenisher)

Ion-exchanged water (calcium and magnesium concentration: 3 ppm each)

In each running test, each specimen was subjected to gradient exposure to light through a sensitometry filter by means of a sensitometer (Type FWH sensitometer produced by Fuji Photo Film Co., Ltd.; color temperature of light source: 3,200° K.) at the beginning and end of the running test (The exposure was effected in such manner that an exposure of 250 CMS was reached in an exposure time of 0.1 second). The specimens thus exposed were developed, and then measured for density both at the start of continuous processing and at the end of the running test by means of an autograph densitometer. The change in the maximum optical yellow (Y), magenta (M) and cyan (C) densities (Dmax) between the start of continuous processing and the end of the running test are set forth in Table 6.

The running solutions were each stored at a temperature of 40° C. in a 200-ml beaker with a vinyl chloride plate having a 1-mm deep and 1-mm wide slit standing therein. After two weeks, the height of crystals deposited in the slit from the liquid level was measured. The evaporation loss was made up for by daily addition of water to maintain the liquid level. The replenishers were each stored at a temperature of 5° C. After one week, the degree of crystallization was evaluated. The formulae of the additives (A), (B), and (C) are given below. The results are set forth in Table 6. These are the Exemplary Compounds disclosed in JP-A3-223757 and JP-A-3-240054.

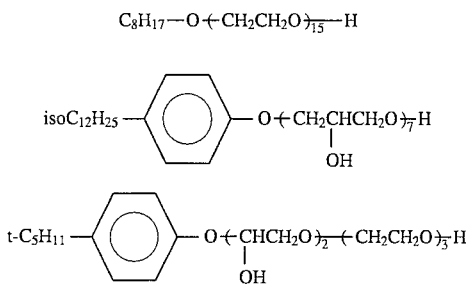

(A)

(B)

(C)

EXAMPLE 2

Multi-layer color photographic paper specimens B, C and D were prepared in the same manner as the multi-layer color photographic paper specimen A of Example 1 except that the silver chloride content in the silver chlorobromide emulsion in each layer was changed as set forth in Table 7.

TABLE 6

| | Sulfite concentration (M) | | | Max. optical density change | | | Deposited amount | Crystallization | |
|---|---|---|---|---|---|---|---|---|---|
| No. | Tank | Replenisher | Additives | Y | M | C | (mm) | at low temp. | Remarks |
| 1 | 0.004 | 0.006 | — | −0.18 | −0.24 | −0.28 | 7 | Fair | Comparative |
| 2 | 0.004 | 0.006 | A | −0.14 | −0.20 | −0.24 | 4 | Poor | " |
| 3 | 0.004 | 0.006 | B | −0.15 | −0.21 | −0.24 | 4 | Poor | " |
| 4 | 0.004 | 0.006 | C | −0.16 | −0.22 | −0.27 | 4 | Poor | " |
| 5 | 0.004 | 0.006 | I-8 | −0.16 | −0.23 | −0.27 | 2 | Fair | " |
| 6 | 0.004 | 0.006 | I-16 | −0.16 | −0.21 | −0.24 | 2 | Fair | " |
| 7 | 0.004 | 0.006 | I-31 | −0.15 | −0.22 | −0.26 | 2 | Fair | " |
| 8 | — | — | — | −0.12 | −0.19 | −0.18 | 21 | Fair | " |
| 9 | 0.002 | 0.003 | — | −0.15 | −0.21 | −0.23 | 19 | Fair | " |
| 10 | 0.002 | 0.003 | A | −0.14 | −0.20 | −0.22 | 7 | Poor | " |
| 11 | 0.002 | 0.003 | C | −0.15 | −0.21 | −0.22 | 6 | Poor | " |
| 12 | 0.002 | 0.003 | I-8 | −0.03 | −0.05 | −0.05 | 2 | Excellent | Present Invention |
| 13 | 0.002 | 0.003 | I-16 | −0.04 | −0.06 | −0.07 | 2 | Excellent | Present Invention |
| 14 | 0.002 | 0.003 | I-31 | −0.03 | −0.07 | −0.07 | 2 | Excellent | Present Invention |
| 15 | — | — | A | −0.12 | −0.17 | −0.18 | 10 | Poor | Comparative |
| 16 | — | — | B | −0.11 | −0.16 | −0.17 | 9 | Poor | " |
| 17 | — | — | C | −0.11 | −0.16 | −0.17 | 10 | Poor | " |
| 18 | — | — | I-8 | −0.02 | −0.02 | −0.03 | 0 | Excellent | Present Invention |
| 19 | — | — | I-16 | −0.01 | −0.02 | −0.02 | 0 | Excellent | Present Invention |
| 20 | — | — | I-31 | −0.01 | −0.01 | −0.02 | 0 | Excellent | Present Invention |

(Note)
M: mole/l
Poor: considerable crystallization observed
Fair: slight crystallization observed
Excellent: no crystallization observed In accordance with the present invention, the change in maximum optical density, the deposition of crystals and the crystallization at low temperatures are remarkably reduced (see Specimen Nos. 12–24, 18–20). In particular, the effects of the invention are pronounced when the system is free of sulfite (see Specimen Nos. 18–20). These effects were unexpected because the change in maximum optical density is about the same when the sulfite concentration is high, whether or not the color developer contains the compound represented by formula (I) of the invention (compare Specimen Nos. 1–4 with Specimen Nos. 5–7).

TABLE 7

| Specimen | A | B | C | D |
|---|---|---|---|---|
| 1st layer | 99.7 | 95.9 | 90.9 | 86.1 |
| 3rd layer | 99.5 | 95.8 | 90.7 | 86.0 |
| 5th layer | 99.5 | 95.7 | 90.5 | 86.2 |
| Unit: mol % | | | | |

The photographic paper specimens A, B, C and D thus prepared were then subjected to running test in the same manner as Specimen Nos. 1, 5, 8 and 18 of Example 1, respectively. The change in the maximum density and the deposited amount of crystals were evaluated in the same manner as in Example 1.

The results are set forth in Table 8.

TABLE 8

| Test No. | Specimen: Color photographic paper | Specimen: Color developer No. | Change in max. optical density: Y | M | C | Deposited amount (mm) | Remarks |
|---|---|---|---|---|---|---|---|
| 1 | A | 1 | −0.18 | −0.24 | −0.28 | 6 | Comparative |
| 2 | A | 5 | −0.16 | −0.22 | −0.25 | 5 | " |
| 3 | A | 8 | −0.12 | −0.19 | −0.18 | 19 | " |
| 4 | A | 18 | −0.01 | −0.01 | −0.02 | 0 | Present Invention |
| 5 | B | 1 | −0.17 | −0.25 | −0.29 | 5 | Comparative |
| 6 | B | 5 | −0.17 | −0.23 | −0.27 | 5 | " |
| 7 | B | 8 | −0.13 | −0.19 | −0.19 | 18 | " |
| 8 | B | 18 | −0.03 | −0.04 | −0.05 | 2 | Present Invention |
| 9 | C | 1 | −0.17 | −0.21 | −0.25 | 7 | Comparative |
| 10 | C | 5 | −0.16 | −0.20 | −0.24 | 5 | " |
| 11 | C | 8 | −0.10 | −0.15 | −0.18 | 19 | " |
| 12 | C | 18 | −0.03 | −0.05 | −0.05 | 2 | Present Invention |
| 13 | D | 1 | −0.18 | −0.24 | −0.28 | 5 | Comparative |
| 14 | D | 5 | −0.17 | −0.22 | −0.26 | 4 | " |
| 15 | D | 8 | −0.13 | −0.19 | −0.22 | 22 | " |
| 16 | D | 18 | −0.05 | −0.08 | −0.09 | 4 | Present Invention |

Table 8 shows that the present invention (Nos. 4, 8, 12, 16) comprising processing a photographic material having a high silver chloride silver halide emulsion content reduces both the change in maximum density and the deposition of crystals. In particular, these effects are remarkably achieved with Specimen No. 4, which has a silver chloride content of more than 98 mol %.

EXAMPLE 3

The surface of a polyethylene double-laminated paper support was subjected to corona discharge. On the paper support was provided a gelatin undercoating layer containing sodium dodecylbenzenesulfonate. On the undercoating layer were coated various photographic constituent layers to prepare a multilayer color photographic paper (301) having the following layer construction. The coating solutions were prepared as follows:

Preparation of 1st Layer Coating Solution 153.0 g of a yellow coupler (ExY), 15.0 g of a dye image stabilizer (Cpd-1), 7.5 g of a dye image stabilizer (Cpd-2), and 16.0 g of a dye image stabilizer (Cpd-3) were dissolved in 25 g of a solvent (Solv-1), 25 g of a solvent (Solv-2) and 180 ml of ethyl acetate. The solution thus obtained was then subjected to emulsion dispersion in 1,000 g of a 10 wt. % aqueous solution of gelatin containing 60 ml of 10 wt. % sodium dodecylbenzenesulfonate and 10 g of citric acid to prepare an emulsion dispersion A. On the other hand, a silver bromochloride emulsion A (3:7 (Ag molar ratio) mixture of a large size emulsion A of cubic grains having an average size of 0.88 μm with a grain size distribution fluctuation coefficient of 0.08 and a small size emulsion A of cubic grains having an average size of 0.70 μm with a grain size distribution fluctuation coefficient of 0.10, 0.3 mol % silver bromide partially localized on the grain surface of each emulsion) was prepared. This emulsion comprised blue-sensitive sensitizing dyes A and B having the chemical structures set forth below in an amount of $2.0\times10^{-4}$ mol per mol of Ag for the large size emulsion and $2.5\times10^{-4}$ mol per mol of Ag for the small size emulsion. The chemical ripening of this emulsion was carried out by the addition of a sulfur sensitizer and a gold sensitizer. The previously prepared emulsion dispersion A and the silver bromochloride emulsion A were mixed to prepare a coating solution for the 1st layer having the formulations set forth below.

The coating solutions for the 2nd layer to the 7th layer were prepared in the same manner as the coating solution for the 1st layer. The sodium salt of 1-oxy-3,5-dichloro-s-triazine was added as a gelatin hardener to each layer.

To each of these layers were added Cpd-14 and Cpd-15 in a total amount of 25.0 mg/m$^2$ and 50.0 mg/m$^2$, respectively.

To the silver bromochloride emulsion in these light-sensitive emulsion layers were added the following spectral sensitizing dyes.

Blue-Sensitive Emulsion Layer

Sensitizing dye A

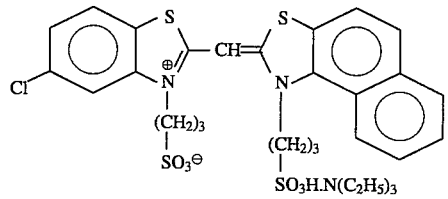

Sensitizing dye B

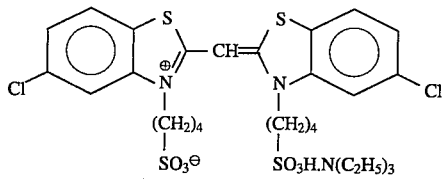

(each of dyes was used in an amount of $2.0\times10^{-4}$ mole per mole of silver halide for the large size emulsion and 2.5×

$10^{-4}$ mole per mole of silver halide for the small size emulsion),

Green-Sensitive Emulsion Layer

Sensitizing dye C

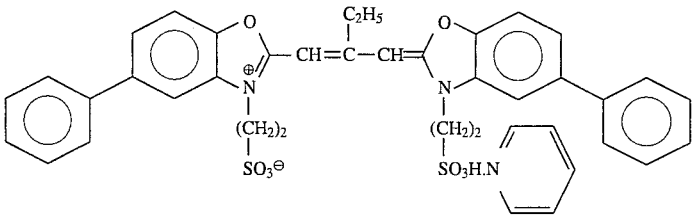

($4.0\times10^{-4}$ mol per mol of silver halide for the large size emulsion and $5.6\times10^{-4}$ mol per mol of silver halide for the small size emulsion), Sensitizing dye D

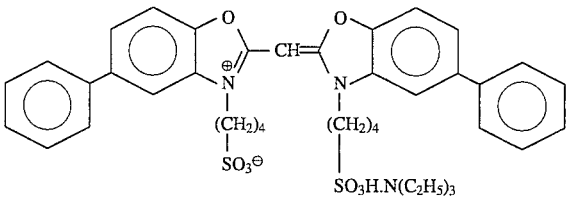

($7.0\times10^{-5}$ mol per mol of silver halide for the large size emulsion and $1.0\times10^{-5}$ mol per mol of silver halide for the small size emulsion).

Red-Sensitive Emulsion Layer

Sensitizing dye E

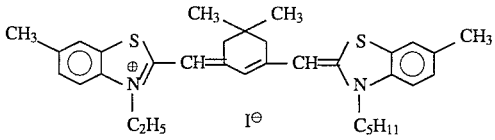

($0.9\times10^{-4}$ mol per mol of silver halide for the large size emulsion and $1.1\times10^{-4}$ mol per mol of silver halide for the small size emulsion).

Furthermore, a compound having the chemical structure set forth below was added to the emulsion in an amount of $2.6\times10^{-3}$ mol per mol of silver halide.

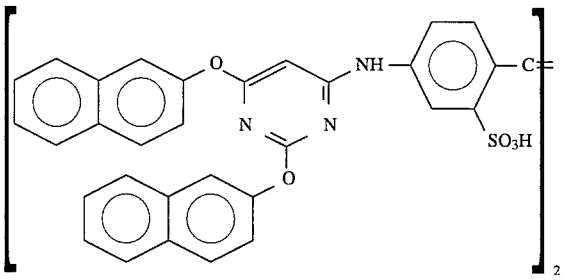

To each of the blue-sensitive emulsion layer, the green-sensitive emulsion layer and the red-sensitive emulsion layer were added 1-(5-methylureidophenyl)-5-mercaptotetrazole in an amount of $8.5\times10^{-5}$ mol, $7.7\times10^{-4}$ mol and $2.5\times10^{-4}$ mol per mol of silver halide, respectively.

To each of the blue-sensitive emulsion layer and the green-sensitive emulsion layer were added 4-hydroxy-6-methyl-1,3,3a,7-tetrazaindene in an amount of $1.0\times10^{-4}$ mol and $2.0\times10^{-4}$ mol per mol of silver halide, respectively.

For inhibiting irradiation, the following dyes were added to each of the emulsion layers (figures in the parenthesis indicate the coated amount):

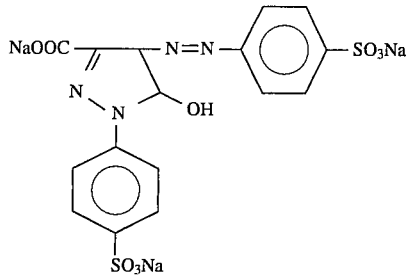

(10 mg/m²)

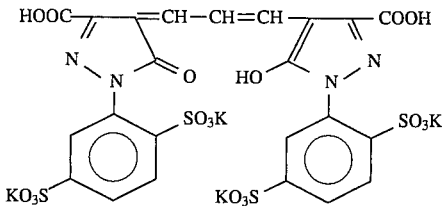

(10 mg/m²)

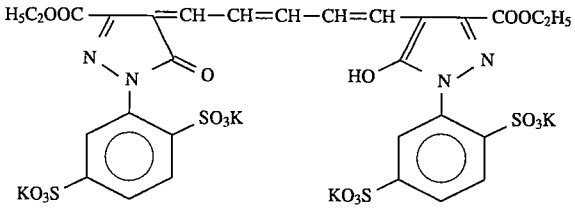

(40 mg/m²)

and

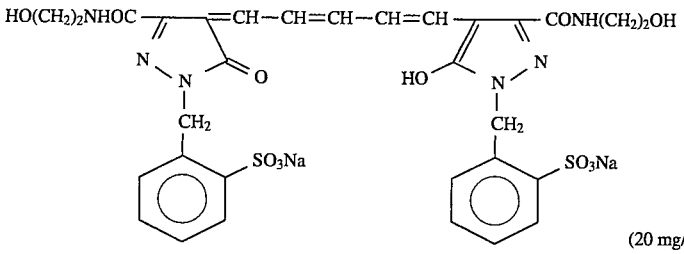

(20 mg/m²)

The formulations of the various layers are set forth below. The figures indicate the coated amount (g/m²). The coated amount of silver halide emulsion is expressed (by calculation) in terms of the coated amount of silver.

| | |
|---|---|
| Support | |
| Polyethylene-laminated paper [containing a white pigment ($TiO_2$) and a bluish dye (ultramarine) in polyethylene on the 1st layer side] | |
| 1st layer (blue-sensitive emulsion layer) | |
| Silver bromochloride emulsion A as mentioned above | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| 2nd layer (color stain inhibiting layer) | |
| Gelatin | 1.00 |
| Color mixing inhibitor (Cpd-4) | 0.06 |
| Solvent (Solv-7) | 0.03 |
| Solvent (Solv-2) | 0.25 |
| Solvent (Solv-3) | 0.25 |
| 3rd layer (green-sensitive emulsion layer) | |
| Silver bromochloride emulsion (1:3 (Ag molar ratio) mixture of a large size emulsion B of cubic grains having an average size of 0.55 μm with a grain | 0.13 |

-continued

| | |
|---|---|
| size distribution fluctuation coefficient of 0.10 and a small size emulsion B of cubic grains having an average size of 0.39 μm with a grain size distribution fluctuation coefficient of 0.08, 0.8 mol % silver bromide partially localized on the grain surface of each emulsion) | |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| 4th layer (color mixing inhibiting layer) | |
| Gelatin | 0.70 |
| Color mixing inhibitor (Cpd-4) | 0.04 |
| Solvent (Solv-7) | 0.02 |
| Solvent (Solv-2) | 0.18 |
| Solvent (Solv-3) | 0.18 |
| 5th layer (red-sensitive emulsion layer) | |
| Silver bromochloride emulsion (1:4 Ag molar ratio) mixture of a large size emulsion C of cubic grains having an average size of 0.50 μm with a grain size distribution fluctuation coefficient of 0.09 and a small size emulsion C of cubic grains having an average size of 0.41 μm with a grain size distribution fluctuation coefficient of 0.11, 0.8 mol % silver bromide partially localized on the grain surface of each emulsion) | 0.20 |
| Gelatin | 0.85 |
| Cyan coupler (ExC) | 0.33 |
| Ultraviolet absorbent (UV-2) | 0.18 |
| Dye image stabilizer (Cpd-9) | 0.15 |
| Dye image stabilizer (Cpd-10) | 0.15 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Dye image stabilizer (Cpd-1) | 0.33 |
| 6th layer (ultraviolet absorbing layer) | |
| Gelatin | 0.55 |
| Ultraviolet absorbent (UV-1) | 0.38 |
| Dye image stabilizer (Cpd-12) | 0.15 |
| Dye image stabilizer (Cpd-5) | 0.02 |
| 7th layer (protective layer) | |
| Gelatin | 1.13 |
| Acryl-modified copolymer of polyvinyl alcohol (modification degree: 17%) | 0.05 |
| Liquid paraffin | 0.02 |
| Dye image stabilizer (Cpd-13) | 0.01 |

Yellow coupler (ExY)
1:1 (molar ratio) mixture of

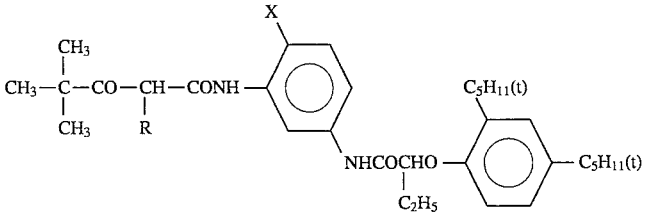

wherein R is

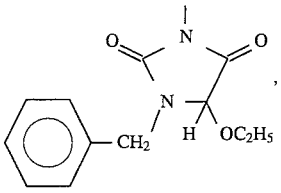

, X = Cl and

-continued
R is 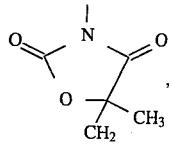 , X = $OCH_3$
Magenta coupler (ExM)
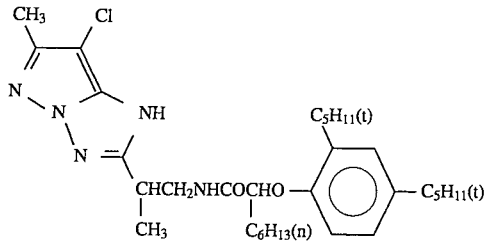
Cyan coupler (ExC)
3:7 (molar ratio) of:
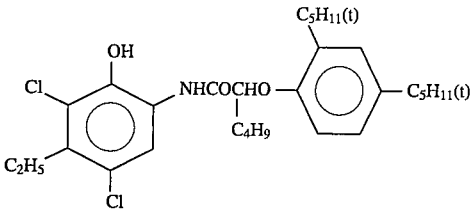
and
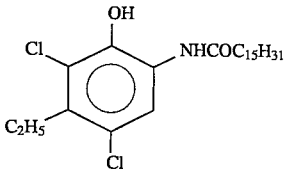
Dye stabilizer (Cpd-1)
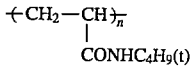
(Average molecular weight: 60,000)
Dye stabilizer (Cpd-2)
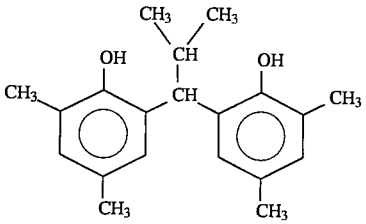
Dye stabilizer (Cpd-3)
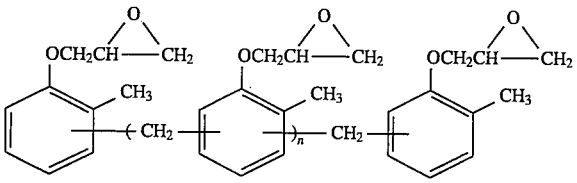
n = 7 to 8 (average value)

-continued
Color mixing inhibitor (Cpd-4)
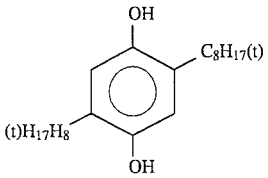
Dye image stabilizer (Cpd-5)
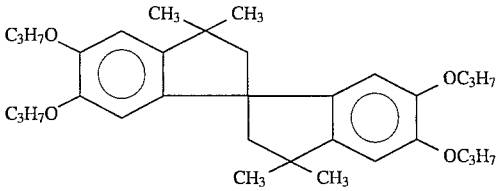
Dye image stabilizer (Cpd-6)
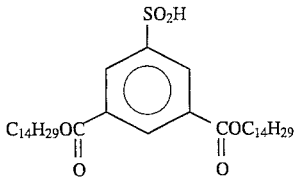
Dye image stabilizer (Cpd-7)
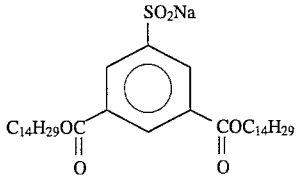
Dye image stabilizer (Cpd-8)
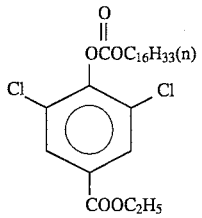
Dye image stabilizer (Cpd-9)
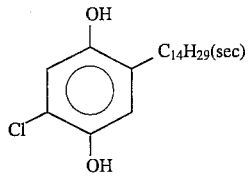
Dye image stabilizer (Cpd-10)
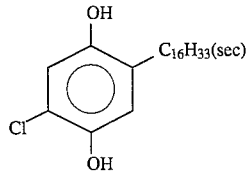

-continued
Dye image stabilizer (Cpd-11)
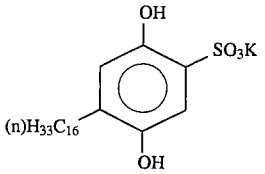
Dye image stabilizer (Cpd-12)
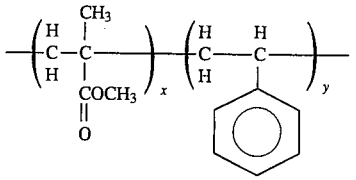
Average molecular weight: 60,000
x:y = 50:50 (molar ratio)
Dye image stabilizer (Cpd-13)
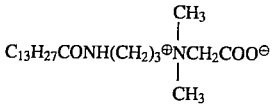
Preservative (Cpd-14)
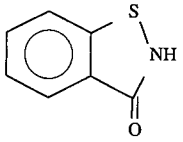
Preservative (Cpd-15)
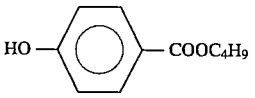
Ultraviolet absorbent (UV-1)
10:5:1:5 (weight ratio) mixture of:
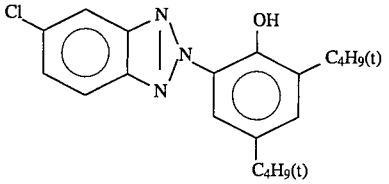
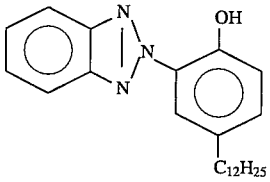
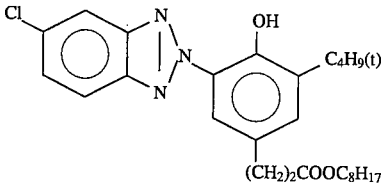

-continued
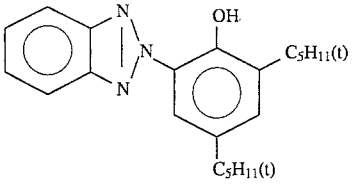
Ultraviolet absorbent (UV-2)
1:2:2 (weight ratio) mixture of:
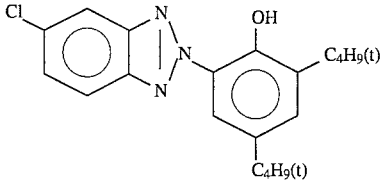
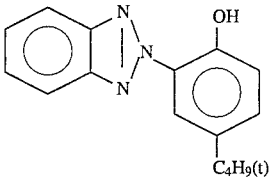
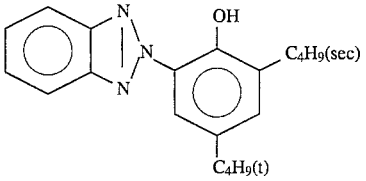
Solvent (Solv-1)
$C_8H_{17}CHCH(CH_2)_7COOC_8H_{17}$
$\quad\quad\ \ \backslash\ /$
$\quad\quad\quad O$
Solvent (Solv-2)
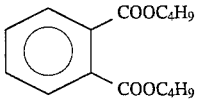
Solvent (Solv-3)
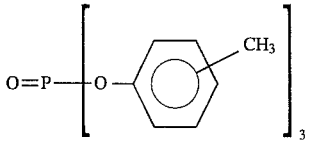
Solvent (Solv-4)
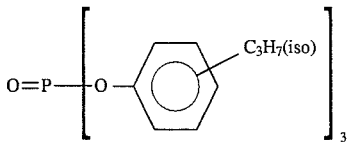
Solvent (Solv-5)
$O{=}P{+}OCH_2\overset{C_2H_5}{\overset{|}{C}}HC_4H_9(n))_3$ -continued Solvent (Solv-6)

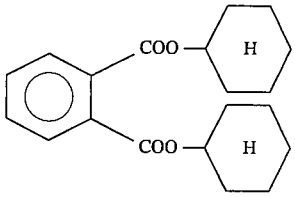

Solvent (Solv-7)

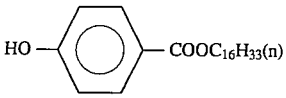

The photographic paper specimen 301 prepared as described above was imagewise exposed to light in the same manner as in Example 1, and then subjected to continuous processing (running test) by the following processing steps until the color developer was replenished by an amount twice the developer volume.

The running test was effected with the formulation of the color developer modified as set forth in Table 16.

| Processing step | Temperature | Time | Replenisher | Tank capacity |
|---|---|---|---|---|
| Color development | 38° C. | 30 sec. | 100 ml/m$^2$ | 10 l |
| Blix | 30–35° C. | 30 sec. | 60 ml/m$^2$ | 10 l |
| Rinse 1 | 30–35° C. | 20 sec. | — | 7 l |
| Rinse 2 | 30–35° C. | 20 sec. | — | 7 l |
| Rinse 3 | 30–35° C. | 20 sec. | 200 | 7 l |

The rinse step was effected in a 3-tank counter-flow process from Rinse 3 to Rinse 1.

The formulations of the various processing solutions were as follows:

| Color developer | Tank Solution | Replenisher |
|---|---|---|
| Water | 800 ml | 800 ml |
| Diethylenetriaminepentaacetic acid | 3 g | 3 g |
| Sodium catechol-3,5-di-sulfonate | 0.3 g | 0.3 g |
| Triethanolamine | 8.0 g | 8.0 g |
| Potassium bromide | 0.02 g | — |
| Sodium chloride | 4.0 g | — |
| N,N-diethyl hydroxylamine | 5.0 g | 7.0 g |
| Fluorescent brightening agent (UVITEX CK produced by Ciba Geigy) | 1.0 g | 1.5 g |
| Sodium sulfite | 0.1 g | 0.1 g |
| Additive (see Table 16) | 0.1 g | 0.1 g |
| N-ethyl-N-(β-methanesulfon-amidoethyl-3-methyl-4-amino aniline sulfate | 5.0 g | 10.0 g |
| Water to make | 1,000 ml | 1,000 ml |
| pH (25° C.) | 10.05 | 11.00 |

-continued

| Blix solution (tank solution) | |
|---|---|
| Water | 800 ml |
| Ammonium thiosulfate (50 wt %) | 120 ml |
| Ammonium sulfite | 17 g |
| Ammonium ethylenediaminetetraacetate iron(III) | 60 g |
| Disodium ethylenediaminetetraacetate | 3 g |
| Glacial acetic acid | 7 g |
| Water to make | 1,000 ml |
| pH (25° C.) | 5.50 |
| **Blix solution replenisher** | |
| Water | 500 ml |
| Ammonium thiosulfate (50 wt %) | 240 ml |
| Ammonium sulfite | 35 g |
| Ammonium ethylenediaminetetraacetate iron(III) | 130 g |
| Ethylenediaminetetraacetic acid | 3 g |
| Glacial acetic acid | 25 g |
| Water to make | 1,000 ml |
| pH (25° C.) | 4.80 |

Washing Solution (The Tank Solution was also used as the Replenisher)

Ion-exchanged water (calcium and magnesium concentration: 3 ppm each)

In each running test, the specimen was measured for the change in the maximum density (between the start of continuous processing and the end of the running test) in the same manner as in Example 1. The developer replenishers were each evaluated for crystallization upon storage at low temperature as in Example 1. The results are set forth in Table 16.

TABLE 16

| Test No. | Additive | Change in max. optical density Y | M | C | Crystallization at low temp. | Remarks |
|---|---|---|---|---|---|---|
| 301 | — | −0.15 | −0.22 | −0.23 | Fair | Comparative |
| 302 | A (same as Example 1) | −0.14 | −0.20 | −0.22 | Poor | " |
| 303 | B | −0.14 | −0.21 | −0.23 | Poor | " |
| 304 | C | −0.15 | −0.22 | −0.23 | Poor | " |
| 305 | I-1 | −0.03 | −0.05 | −0.05 | Excellent | Present Invention |
| 306 | I-4 | −0.05 | −0.07 | −0.07 | Excellent | Present Invention |
| 307 | I-8 | −0.05 | −0.07 | −0.08 | Excellent | Present Invention |
| 308 | I-16 | −0.03 | −0.06 | −0.06 | Excellent | Present Invention |
| 309 | I-19 | −0.03 | −0.05 | −0.06 | Excellent | Present Invention |
| 310 | I-22 | −0.02 | −0.04 | −0.04 | Excellent | Present Invention |
| 311 | I-25 | −0.02 | −0.04 | −0.05 | Excellent | Present Invention |
| 312 | I-27 | −0.02 | −0.05 | −0.05 | Excellent | Present Invention |
| 313 | I-28 | −0.03 | −0.05 | −0.06 | Excellent | Present Invention |
| 314 | I-30 | −0.04 | −0.07 | −0.07 | Excellent | Present Invention |

(Note)
Poor: considerable crystallization observed
Fair: slight crystallization observed
Excellent: no crystallization observed In accordance with the present invention, the change in the photographic properties during continuous processing is considerably reduced, and crystallization of the developer tank solution and replenisher is suppressed upon storage at low temperatures.

While the invention has been described in detail and with reference to specific embodiments thereof, it will be apparent to one skilled in the art that various changes and modifications can be made therein without departing from the spirit and scope thereof.

What is claimed is:

1. A process for processing an imagewise exposed silver halide color photographic material comprising a support having thereon at least one light-sensitive silver halide emulsion layer, comprising the step of developing in a color developer having a sulfite ion concentration of $1\times10^{-3}$ mol/l or less, the color developer containing an aromatic primary amine color developing agent and at least one phosphorus compound selected from the group consisting of compounds represented by formula (I), formula (I-a) and formula (I-b) and internal salts derived from these compounds:

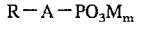

(I)

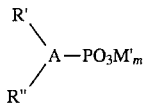

(I-a)

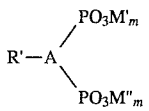

(I-b)

wherein R, R' and R" each represents an aliphatic hydrocarbon group having from 6 to 30 carbon atoms or an aryl group having from 10 to 24 carbon atoms; M, M' and M" each represents a hydrogen atom, an alkali metal atom, an alkaline earth metal atom, an ammonium or a quaternary ammonium; m represents 2 when M, M' or M" is monovalent and m is 1 when M, M' or M" is divalent; and A represents a divalent or trivalent linking group comprising at least one group selected from the group consisting of

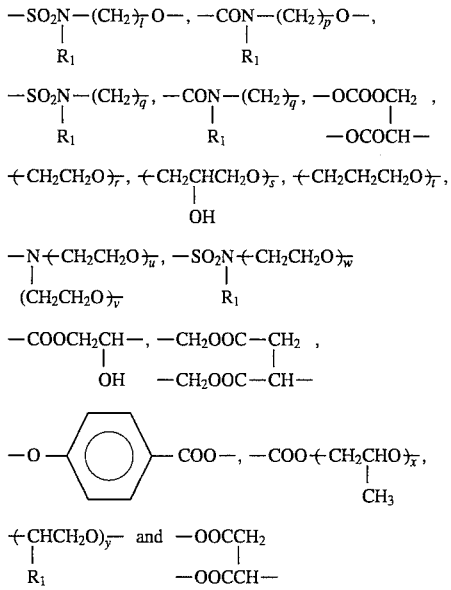

and combinations thereof; wherein $R_1$ represents a hydrogen atom or a substituted or unsubstituted $C_{1-6}$ alkyl group, and l, p, q, r, s, t, u, v, w, x and y each represents an integer of from 1 to 30 except that r, s, t and y each is 2 to 30 when A comprises a single type of the above exemplified linking groups, and when A comprises a combination of the above exemplified linking groups the sum of l to y is from 2 to 60.

2. The process as in claim 1, wherein the aliphatic hydrocarbon or aryl group represented by $R_1$, R' or R" is substituted with at least one substituent selected from the group consisting of a halogen atom, an alkyl group, an alkoxy group, an acyl group, an acyloxy group, an amino group, a hydroxyl group, a nitro group, $—SO_3M^1{}_m$, and $—COOM^1{}_m$, (wherein $M^1$ has the same meaning as M in formula (I), m' is 1 when $M^1$ is monovalent and m' is ½ when $M^1$ is divalent); and said substituents may be further substituted with the above described substituents.

3. The process as in claim 1, wherein the linking group represented by A is selected from the group consisting of $$\left(CH_2CH_2O\right)_r,\ \left(CH_2\underset{\underset{OH}{|}}{C}HCH_2O\right)_s,\ \left(CH_2CH_2CH_2O\right)_t,$$

$$-\underset{\underset{(CH_2CH_2O)_v}{|}}{N}\left(CH_2CH_2O\right)_u,\ -SO_2\underset{\underset{R_1}{|}}{N}\left(CH_2CH_2O\right)_w,$$

$$-COO\left(CH_2\underset{\underset{CH_3}{|}}{C}HO\right)_x,\ \left(\underset{\underset{R_1}{|}}{C}HCH_2O\right)_y-$$

and combinations thereof, $R_1$ represents a hydrogen atom or a substituted or unsubstituted $C_{1-6}$ alkyl group, and r, s, t, u, v, w, x and y each represents an integer of from 1 to 30 except that r, s, t and y each is 2 to 30 when A comprises a single type of the above exemplified linking groups, and when A comprises a combination of the above exemplified linking groups the sum of r to y is from 2 to 60.

4. The process as in claim 1, wherein the linking group represented by A is $—CH_2CH_2O—_r$, wherein r represents an integer of from 1 to 30.

5. The process as in claim 1, wherein R, R' and R" each represents an unsubstituted aliphatic hydrocarbon group having 6 to 30 carbon atoms or an unsubstituted aryl group having from 10 to 24 carbon atoms.

6. The process as in claim 1, wherein the substituent of said substituted $C_{1-6}$ alkyl group is selected from the group consisting of halogen atom, an alkyl group, an alkoxy group, an acyl group, an acyloxy group, an amino group, a hydroxyl group, a nitro group, $—SO_3M^1{}_m$, and $—COOM^1{}_m$, (wherein $M^1$ has the same meaning as M in formula (I), m' is 1 when $M^1$ is monovalent and m' is ½ when $M^1$ is divalent); and said substituents may be further substituted with the above described substituents.

7. The process as in claim 1, wherein said phosphorus compound is incorporated in the color developer in an amount of from 0.01 to 10 g/l.

8. The process as in claim 1, wherein the aromatic primary amine developing agent is contained in the color developer in an amount of from 0.1 to 20 g/l.

9. The process as in claim 1, wherein the color developer is replenished with a replenisher containing the aromatic primary amine developing agent and at least one of said phosphorus compounds.

10. The process as in claim 9, wherein the aromatic primary amine developing agent is incorporated in an amount of from 8 to 30 g/l.

11. The process as in claim 9, wherein the phosphorus compound is incorporated in an amount of from 0.01 to 10 g/l.

12. The process as in claim 1, wherein the color developer is substantially free of benzyl alcohol.

13. The process as in claim 1, wherein the color developer contains chloride ions in an amount of from $3.0\times10^{-2}$ to $1.5\times10^{-1}$ mol/l.

14. The process as in claim 1, wherein the color developer contains bromide ions in an amount of from $3.0\times10^{-5}$ to $1.0\times10^{-3}$ mol/l.

15. The process as in claim 1, wherein the color developer has a pH of from 9 to 12.

16. The process as in claim 1, wherein the developing step is carried out at a color developer temperature of from 20° to 50° C.

17. The process as in claim 1, wherein the developing step is carried out at a color developer temperature of from 37° to 50° C.

18. The process as in claim 1, wherein at least one light-sensitive silver halide emulsion layer comprises silver halide grains having a mean silver chloride content of 90 mol % or more.

19. The process as in claim 1, wherein the color developer has a sulfite ion concentration of zero.

20. The process as in claim 1, wherein the silver halide emulsion layer comprises silver halide containing at least 98 mol % AgCl.

* * * * *